US006763814B2

(12) United States Patent
Gokan

(10) Patent No.: US 6,763,814 B2
(45) Date of Patent: Jul. 20, 2004

(54) OIL TANK SYSTEM FOR ENGINE

(75) Inventor: Yoshitsugu Gokan, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/187,906

(22) Filed: Jul. 3, 2002

(65) Prior Publication Data

US 2003/0037775 A1 Feb. 27, 2003

(30) Foreign Application Priority Data

Jul. 13, 2001 (JP) ..... 2001-213494

(51) Int. Cl.[7] ..... F01M 13/00; F01M 11/00; F02F 7/00; B63H 21/00; B63B 35/73

(52) U.S. Cl. ..... 123/572; 123/196 R

(58) Field of Search ..... 123/572, 573, 123/574, 41.86, 196 R, 196 N

(56) References Cited

U.S. PATENT DOCUMENTS 4,674,457 A * 6/1987 Berger et al. ..... 123/196 R
6,029,638 A * 2/2000 Funai et al. ..... 123/572
6,394,078 B1 * 5/2002 Kling ..... 123/572

FOREIGN PATENT DOCUMENTS

JP 10-252440 A 9/1998

* cited by examiner

*Primary Examiner*—Marguerite McMahon
(74) *Attorney, Agent, or Firm*—Birch, Stewart, Kolasch & Birch, LLP

(57) ABSTRACT

An oil tank system for an engine capable of reducing the overall height of an engine is disclosed. Breather chambers of a dry sump type engine in which an oil tank for storing engine oil is provided independently from the engine are defined in an oil tank. The breather chambers and are in communication with the engine and a breather chamber section is partially partitioned into the first breather chamber and the second breather chamber with a gasket. An oil sump portion for accumulating oil during period of turn-over of a watercraft is formed in the first breather chamber. An oil return passage provided in the first breather chamber forms a breathing passage during a turn-over condition of the watercraft. A sump portion for oil which counter flows in the return passage during a turn-over condition of the watercraft is provided in an upper portion (lower portion during a turn-over condition) of the second breather chamber.

19 Claims, 19 Drawing Sheets

FIG. 12(b)
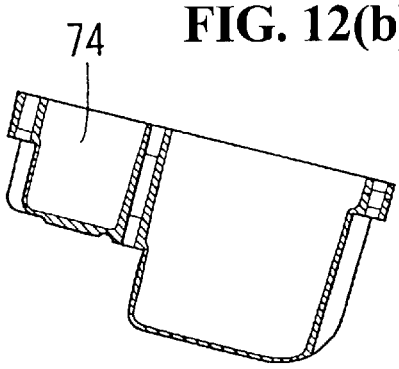
FIG. 12(d)
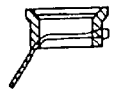
FIG. 12(c)
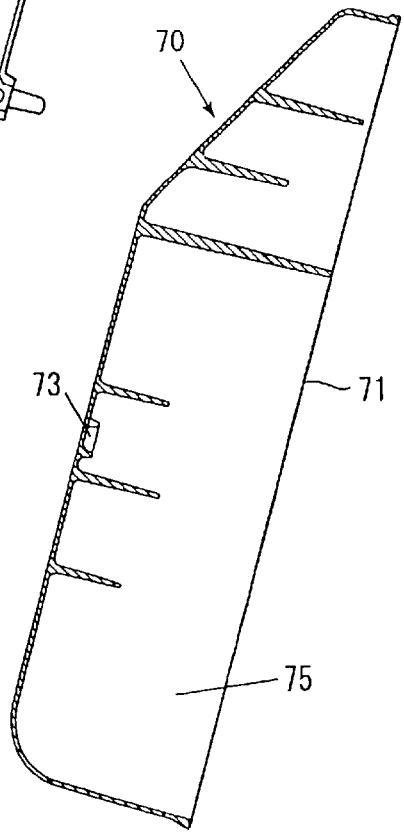
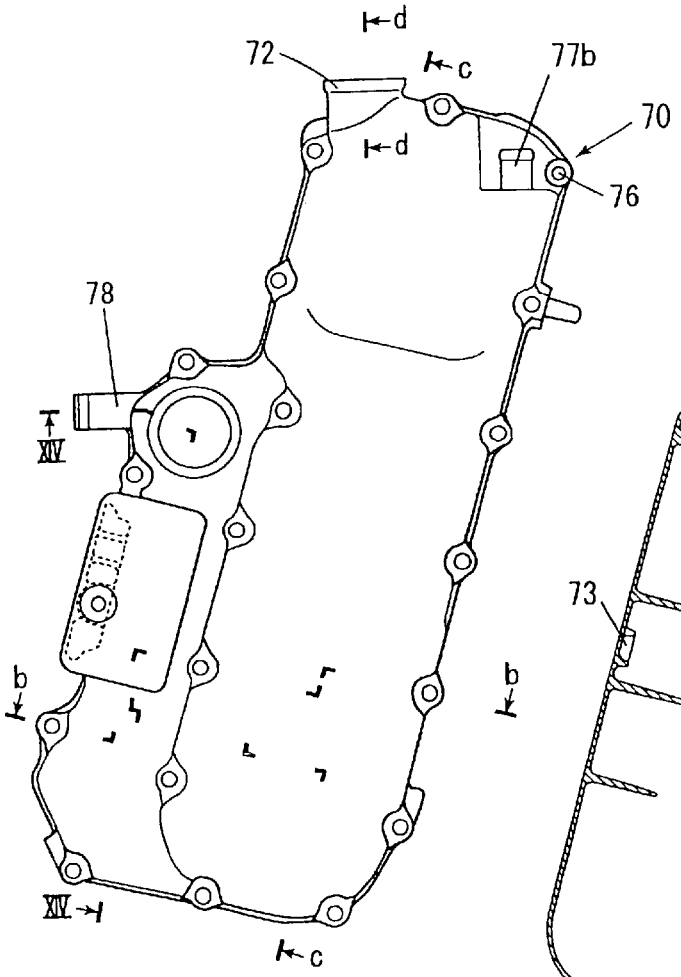
FIG. 12(a)

OIL TANK SYSTEM FOR ENGINE

CROSS-REFERENCES TO RELATED APPLICATIONS

This nonprovisional application claims priority under 35 U.S.C. §119(a) on Patent Application No. 2001-213494 filed in Japan on Jul. 13, 2001, the entirety of which is herein incorporated by reference.

BACKGROUND OF THE INVENTION

1. Field of the Invention

The present invention relates to an oil tank system for an engine, and more particularly to an oil tank system for a dry sump type engine in which an oil tank for storing engine oil is provided independently from the engine. An exemplary oil tank system is adapted specifically for an engine mounted on a small watercraft.

2. Description of the Background Art

In recent years, even for small watercraft (particularly, personal watercraft), four-cycle engines have been mounted on these craft in order to reduce environmental pollution due to exhaust gas and for the reduction of noise.

Since personal watercraft are configured such that an engine is substantially enclosed in a narrow space formed by a hull and a deck, the engine is required to be relatively compact. However, since a four-cycle engine has a valve system and further has a large cylinder head, the size of the four-cycle engine generally tends to be large.

Since four-cycle engine require forced lubrication of engine oil, the engine oil is liable to be entrained in crankcase gases circulating in a crankcase. In order to subject the crankcase gas to gas-liquid separation and introduce the gas from which engine oil has been separated again into a combustion chamber, there have been proposed various breather systems for accomplishing the gas-liquid separation.

For example, in conventional four-cycle engines, a breather chamber is formed only in a cylinder head cover (see Japanese Patent Laid-open No. Hei 10-252440).

However, since a breather chamber is formed only in a cylinder head cover in conventional four-cycle engines, the present inventors have determined that the entire size, particularly the overall height, of the engine becomes large. Accordingly, the task of mounting a four-cycle engine in a small watercraft body has become exceedingly difficult.

SUMMARY OF THE INVENTION

The present invention overcomes the shortcomings associated with the background art and achieves other advantages not realized by the background art.

An object of the present invention is to provide an oil tank system for an engine, which is capable of reducing the size, e.g., the height, of the engine.

An object of the present invention is to provide an oil tank system that solves the aforementioned problems associated with the background art and otherwise not realized by the background art.

One or more of these and other objects are accomplished by an oil tank system for a dry sump engine, the oil tank system comprising an oil tank for storing engine oil provided independently from the engine; and a breather chamber being provided within the oil tank, the breather chamber being in fluid communication with the engine.

One or more of these and other objects are further accomplished by an oil tank system for a dry sump engine of a personal watercraft, the dry sump engine driving a jet pump drive of the personal watercraft, the oil tank system comprising an oil tank for storing engine oil provided independently from the engine; a breather chamber being provided within the oil tank, the breather chamber being in fluid communication with the engine; a water-cooled oil cooler; and an oil cooler accommodating portion formed integrally with the oil tank, wherein cooling water from a cooling water takeoff portion in the jet pump is first supplied to the water-cooled type oil cooler accommodating portion.

According to an alternative aspect of the present invention, the oil tank may include divided cases joined to each other, and the breather chamber being formed by joining the divided cases to each other. Further, a breathing gas inlet for supplying breathing gas to the breather chamber may be provided in an upper portion of the oil tank. A breathing gas outlet for discharging the breathing gas from the breather chamber is provided at a position lower than that of the breathing gas inlet and an oil return passage for returning oil having been separated in the breather chamber is provided in the oil tank.

Alternatively, or in combination therewith, the divided cases of the oil tank are joined to each other via a gasket; the breather chamber is partially partitioned into a first breather chamber and a second breather chamber by the gasket; and the breathing gas inlet is provided in the first breather chamber and the breathing gas outlet is provided in the second breather chamber. Alternatively, or in combination therewith, the oil tank forms a cover portion of an AC generator disposed at an end of a crankshaft of the engine.

A pulser for extracting a signal may be provided on an outer periphery of the AC generator in such a manner as to overlap the oil tank in a direction along the crankshaft. A water-cooled type oil cooler accommodating portion for an oil cooler may be formed integrally with the oil tank.

Alternatively, and/or in combination therewith, an oil filter is provided in the oil tank and the oil cooler is interposed in an oil passage extending from the oil filter to a main gallery of the engine. If the engine is an engine mounted on a small watercraft for driving a jet pump, cooling water from a cooling water takeoff portion in the jet pump is first supplied to the water-cooled type oil cooler accommodating portion. Further, the breather chamber may form an oil sump during a turn-over condition of the watercraft and/or oil system. The return passage may form a breathing passage during the aforementioned turn-over condition of the watercraft. The sump portion for a counter flow of oil in the return passage during the turn-over condition of the watercraft may be provided in an upper portion (lower portion, during the turn-over condition of the watercraft) of the second breather chamber.

The breather chamber of a dry sump type engine in which the oil tank for storing engine oil is provided independently from the engine is defined in the oil tank and the breather chamber is in communication with the engine. Accordingly, it is possible to eliminate the need for of provision of a breather chamber in a head cover or the like of the engine. Therefore, it is possible to significantly reduce the volume of the breather chamber.

It also possible to reduce the entire size, particularly, the overall height of the engine and to more easily accommodate a four-cycle engine in a small watercraft body. As a result, it is possible to provide a smaller watercraft that still capitalizes on the reduced environmental pollution and noise benefits of four-cycle engines.

If the oil tank is composed of divided cases joined to each other, and the breather chamber is formed by joining the divided cases to each other, it is possible to freely set the volume, shape, and the like of the breather chamber. If the breathing gas inlet of the breather chamber is provided in the upper portion of the oil tank and the breathing gas outlet of the breather chamber is provided at a position lower than that of the breathing gas inlet and the return passage is provided in the oil tank, it is thus possible to ensure adequate height is provided for gas-liquid separation in the breather chamber, and to simplify the return of separated oil.

The divided cases are joined to each other via the gasket, and the breather chamber is partitioned into the first breather chamber and the second breather chamber via the gasket. The breathing gas inlet may be provided in the first breather chamber and the breathing gas outlet may be provided in the second breather chamber. It is thus possible to perform gas-liquid separation more reliably.

If the oil tank forms the cover portion of the AC generator disposed at an end of the crankshaft of the engine, it is possible to reduce the number of required parts and to obtain a desirable noise absorption effect, e.g, due to the surrounding oil as compared with a single cover liable to induce radiation noise occurring from the engine. Accordingly, it is possible to reduce the degree of noise occurring from the engine.

The pulser for taking out a signal is provided on the outer periphery of the AC generator in such a manner as to overlap the oil tank in a direction along the crank shaft. Accordingly, the axial length required for the pulser does not need to be elongated. As a result, it is possible to make the engine more compact.

The water-cooled type oil cooler accommodating portion may be formed integrally with the oil tank. Therefore, it is possible to simplify an oil piping structure and a cooling water piping structure. If the oil filter is provided in the oil tank and the oil cooler is interposed in the oil passage extending from the oil filter to the main gallery of the engine, it is possible to supply the coolest oil from the system to the main gallery of the engine.

If the engine is an engine mounted on a small watercraft for driving a jet pump and cooling water from the cooling water takeoff portion of the jet pump is first supplied to the water-cooled type oil cooler accommodating portion, it is possible to efficiently cool not only oil passing through the oil cooler, but also oil stored within the oil tank. Alternatively, or in combination therewith, the breather chamber may form the oil sump portion for accumulating oil the turn-over condition of the watercraft. Therefore, it is possible to prevent the outflow of oil during this condition.

If the return passage forms the breathing passage during the turn-over condition of the watercraft, it is possible to prevent the outflow of oil with more certainty. If the sump portion for oil which counter flows in the return passage during the turn-over condition of the watercraft is provided in the upper portion (lower portion, during the turn-over condition) of the second breather chamber, it is possible to prevent the outflow of oil with more certainty.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIGS. 12(*a*) to 12(*d*) are views showing a cover 70, wherein FIG. 12(*a*) is a front view, FIG. 12(*b*) is a sectional view taken along line b—b of FIG. 12(*a*), FIG. 12(*c*) is a sectional view taken on line c—c of FIG. 12(*a*), and FIG. 12(*d*) is a sectional view taken on line d—d of FIG. 12(*a*);

DETAILED DESCRIPTION OF THE PREFERRED EMBODIMENTS

Figure 1:
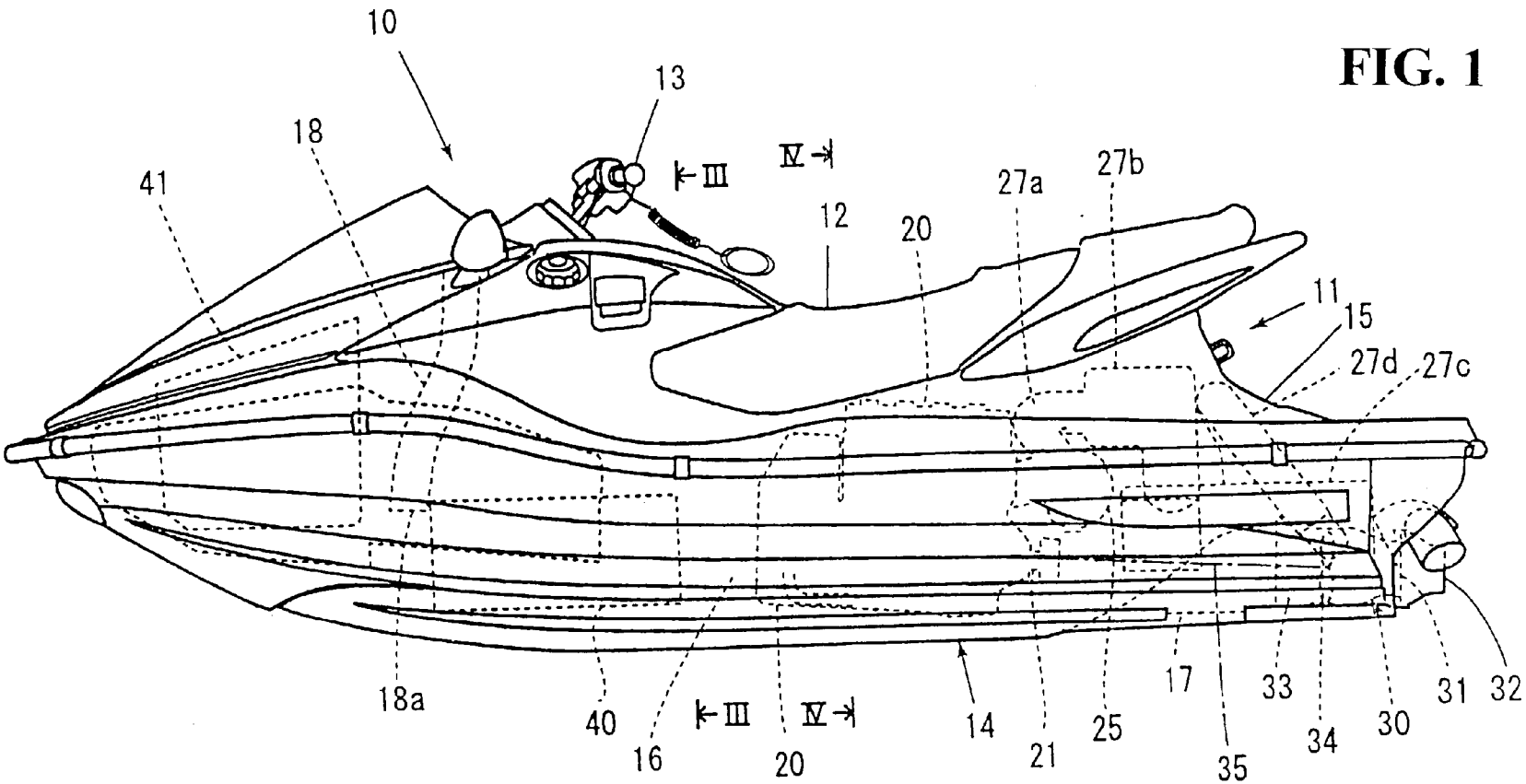
FIG. 1 is a side view showing an example of a personal watercraft of an oil tank system for an engine according to an embodiment the present invention.
Figure 2:
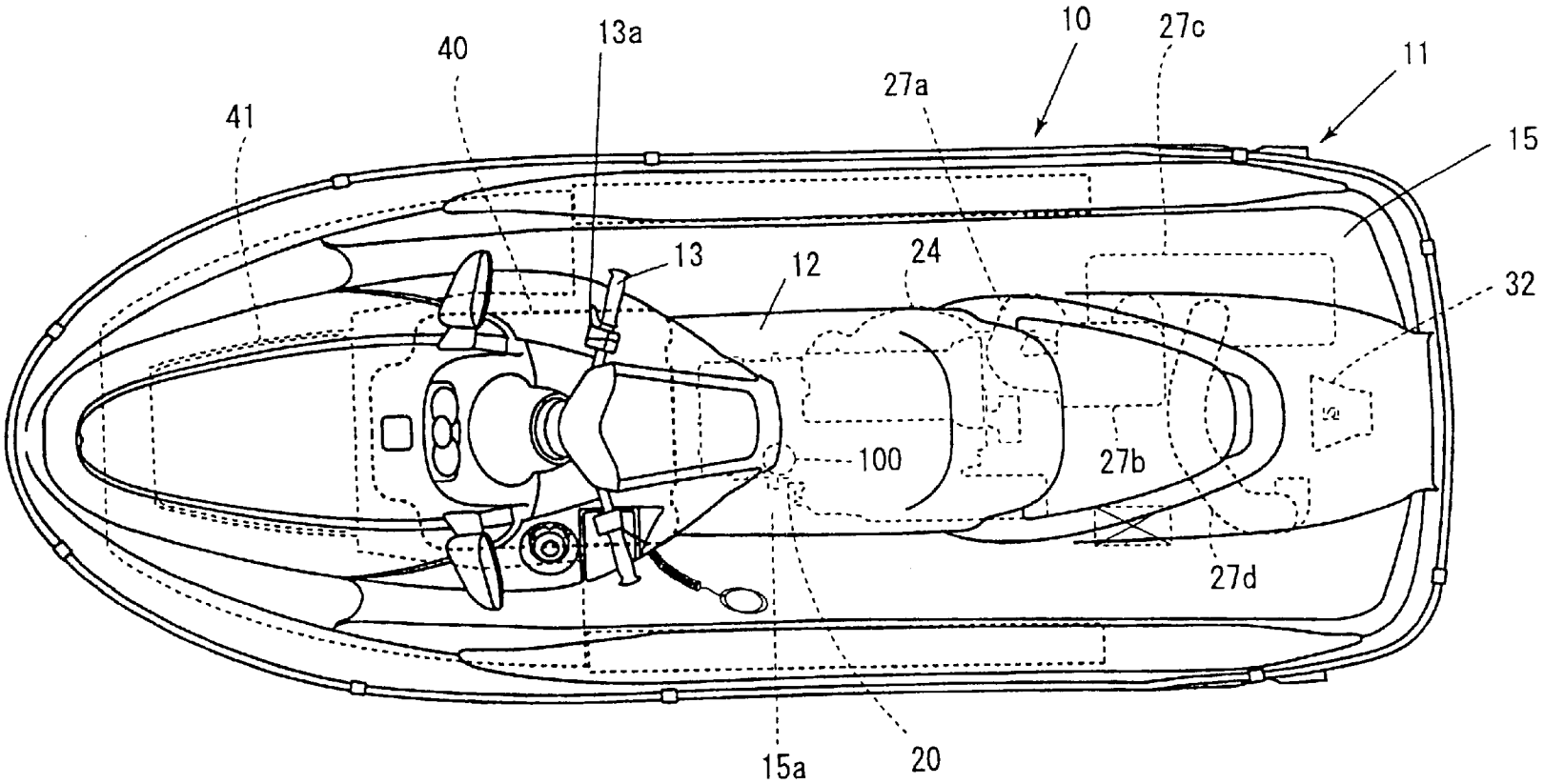
FIG. 2 is a plan view of the personal watercraft shown in FIG. 1.
Figure 3:
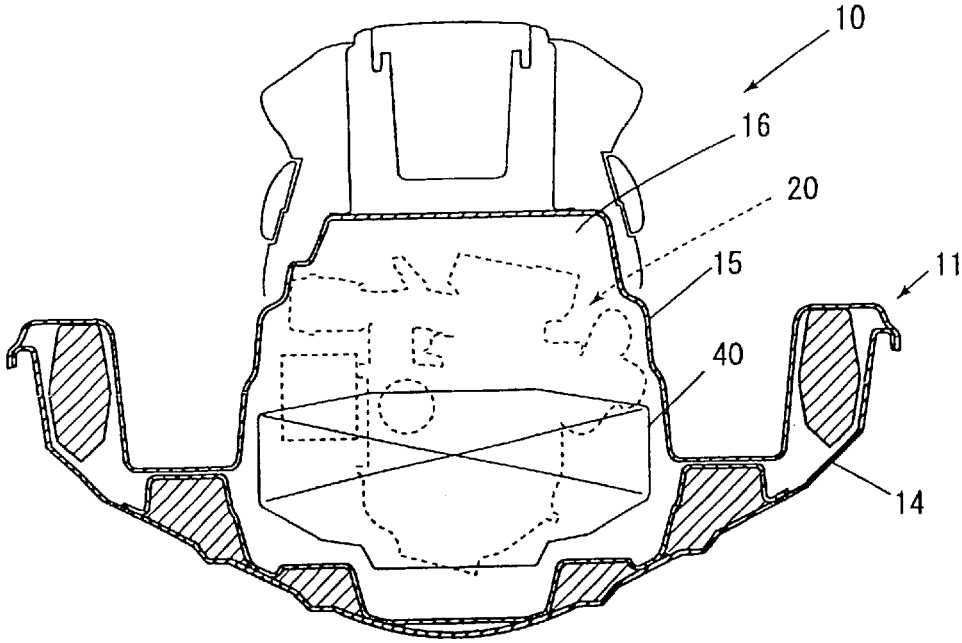
FIG. 3 is a partial, enlarged sectional view taken along line III—III of FIG. 1.

The present invention will hereinafter be described with reference to the accompanying drawings. Hereinafter, an embodiment of the present invention will be described with reference to the accompanying drawings. FIG. 1 is a side view showing an example of a personal watercraft of an oil tank system for an engine according to an embodiment the present invention. FIG. 2 is a plan view of the personal watercraft shown in FIG. 1. FIG. 3 is a partial, enlarged sectional view taken along line III—III of FIG. 1 (with parts partially omitted).

As seen in these figures, particularly to FIG. 1, an exemplary personal watercraft 10 is a saddle type small watercraft, e.g., which is being operated by a driver who sits on a seat 12 provided on a watercraft body 11 and holds a steering handlebar 13 provided with a throttle lever. The watercraft body 11 has a floating structure where a hull 14 is joined to a deck 15 so as to form a space 16 therein. An engine 20 is mounted on the hull 14 within the space 16 and a jet pump or jet propelling pump 30 functioning as a propelling device to be driven by the engine 20 is provided on a rear portion of the hull 14.

The jet pump 30 has a flow passage 33 extending from a water inlet 17 opened in a bottom of the hull 14 to both a jet port 31 opened in a rear end portion of the hull 14 and a nozzle 32. An impeller 34 is disposed within the flow passage 33. A shaft 35 of the impeller 34 is connected to an output shaft 21 of the engine 20. When the impeller 34 is rotated by the engine 20, water taken in via the water inlet 17 is jetted from the jet port 31 via the nozzle 32 to propel the watercraft body 11. A rotational speed of the engine 20, e.g., a propelling force of the jet pump 30, is controlled by a turning operation of a throttle lever 13*a* (see FIG. 2) of the steering handlebar 13. The nozzle 32 is coupled to the steering handlebar 13 via a steering wire (not shown) and is turned by operation of the steering handlebar 13 in order to change a running course of the craft 10. A fuel tank 40 and a storing chamber 41 are also shown.

Figure 4:
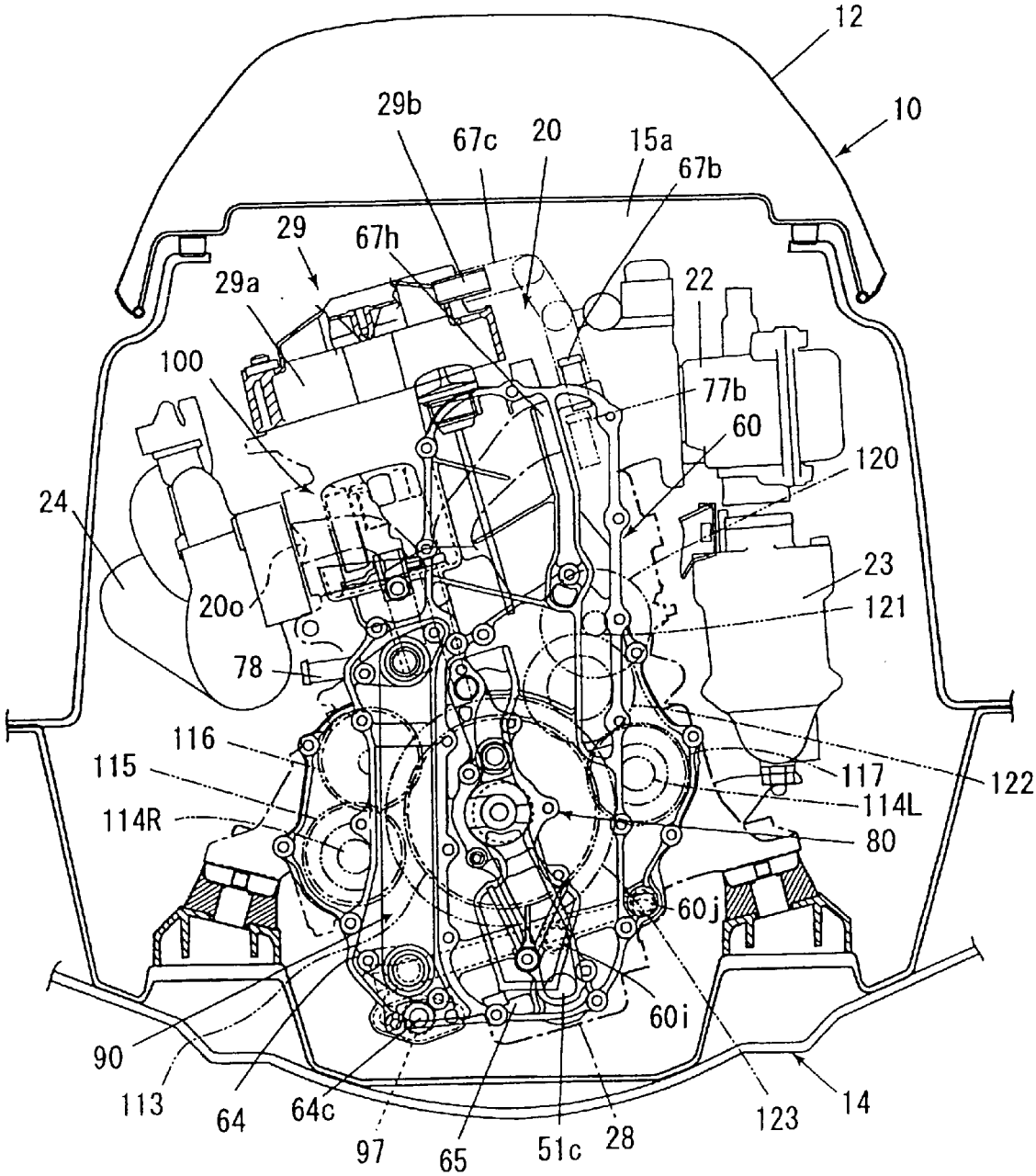
FIG. 4 is a partial, enlarged sectional view taken along line IV—IV of FIG. 1.
Figure 5:
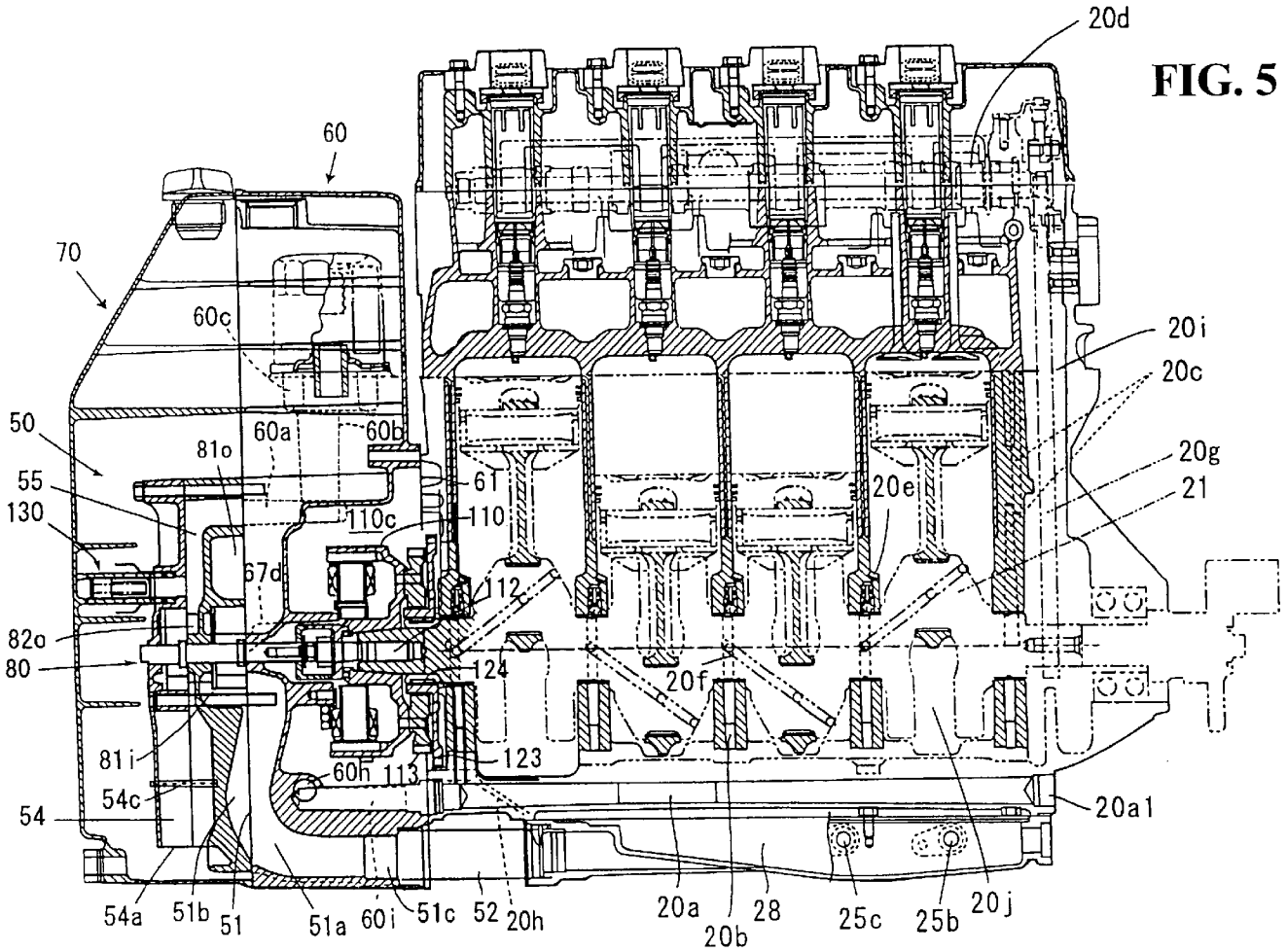
FIG. 5 is a right side view of an engine 20 according to the present invention.
Figure 6:
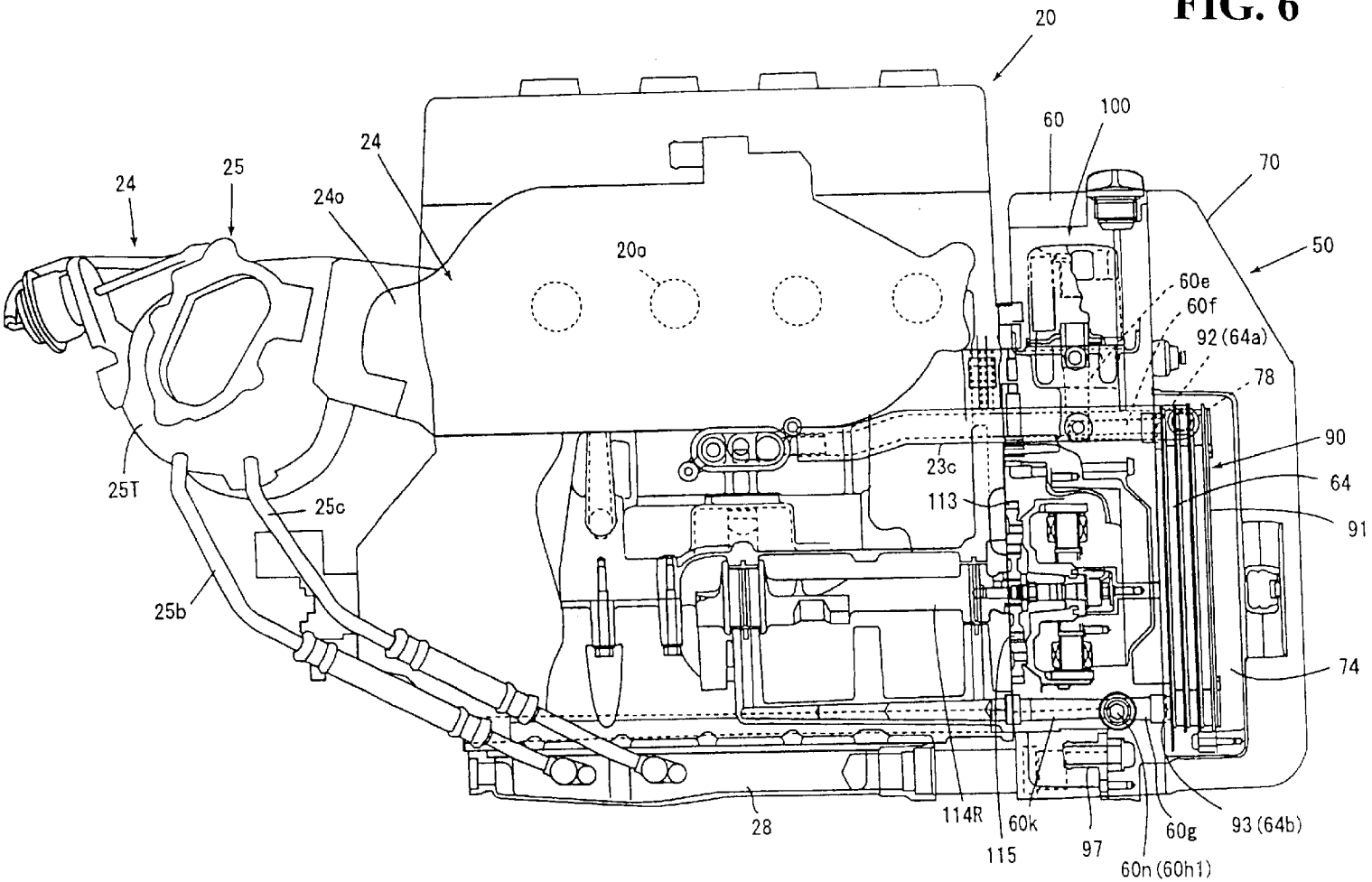
FIG. 6 is a left side view of an engine 20 according to the present invention.
Figure 7:
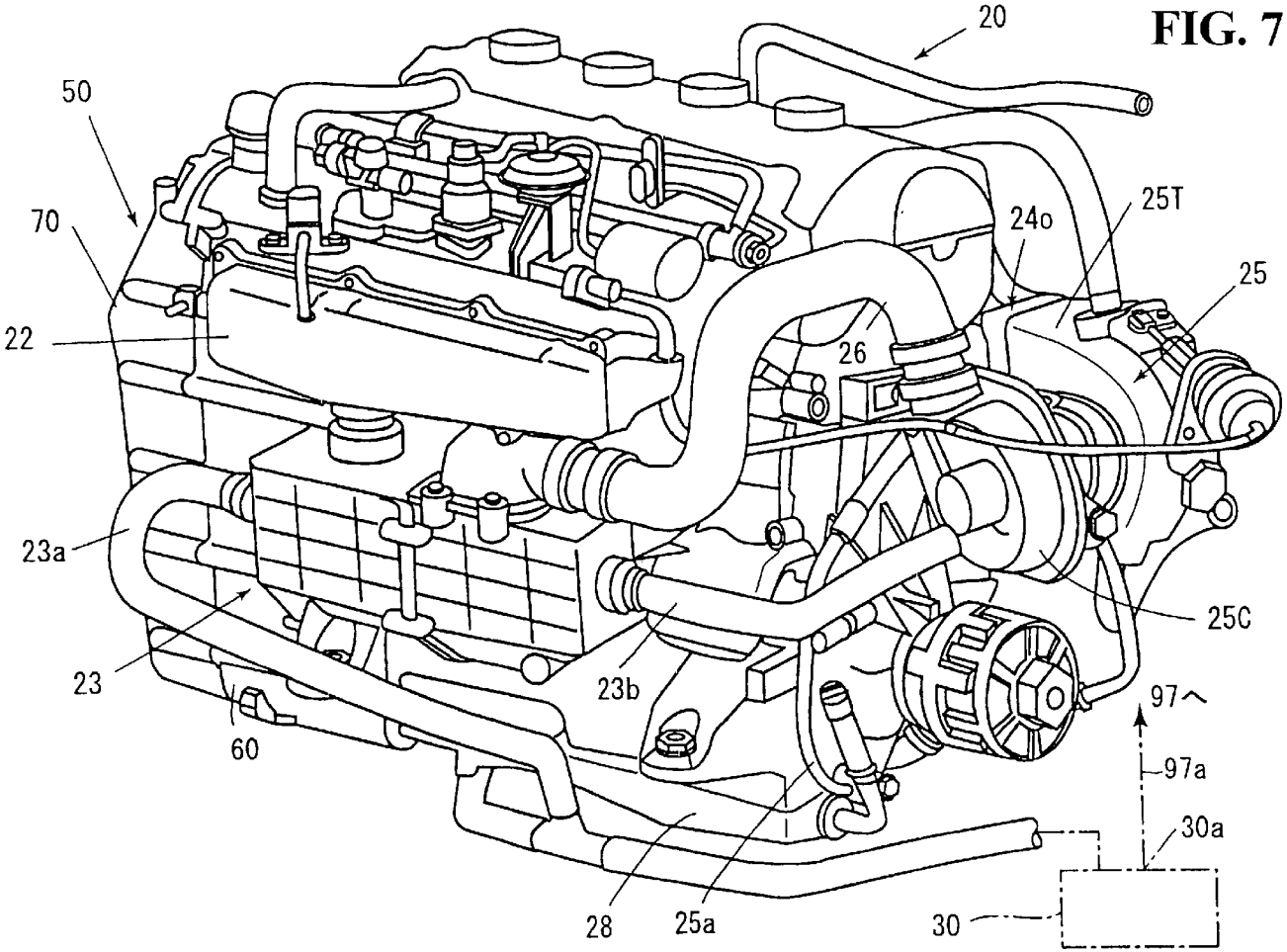
FIG. 7 is a perspective view of the engine 20 as seen from an obliquely rear direction.
Figure 8:
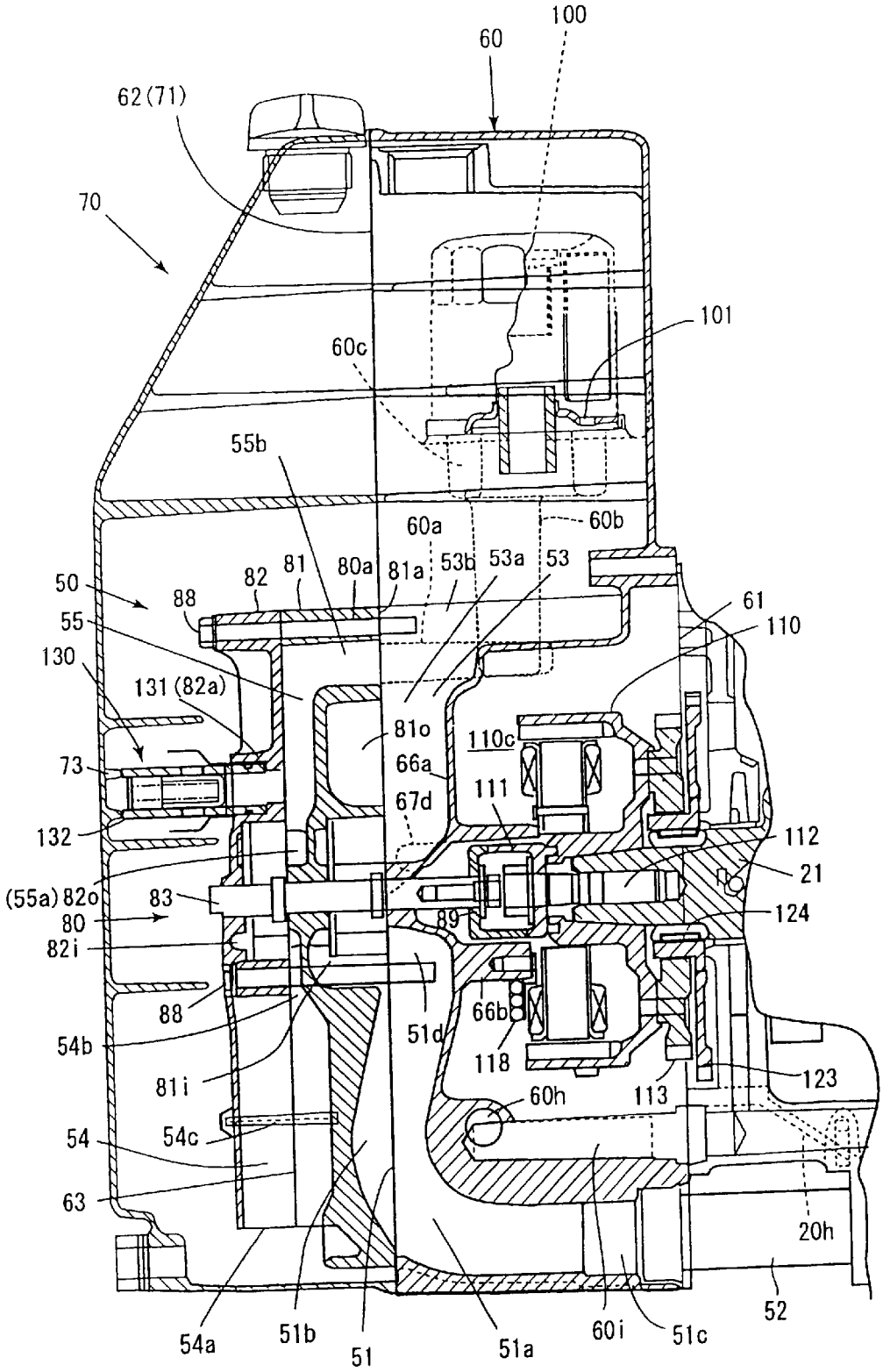
FIG. 8 is an enlarged view of a portion shown in FIG. 5.
Figure 9A:
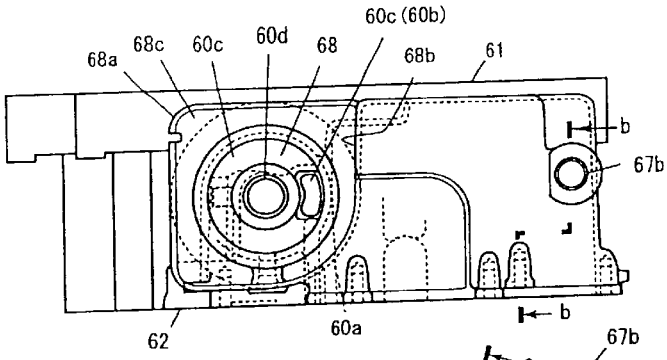
FIGS. 9(*a*) to 9(*d*) are views showing a tank main body 60, wherein FIG. 9(*a*) is a plan view, FIG. 9(*b*) is a front view, FIG. 9(*c*) is a sectional view taken along line c—c of FIG. 9(*b*), and FIG. 9(*d*) is a sectional view taken along line b—b of FIG. 9(*d*)
Figure 9D:
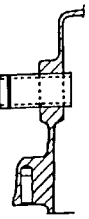
Figure 9B:
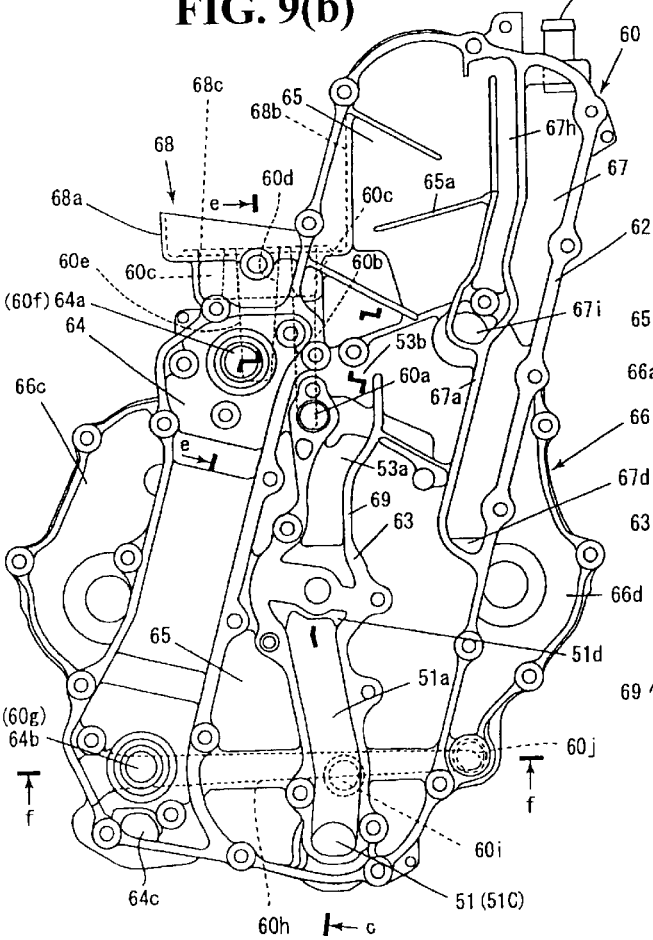
Figure 9C:
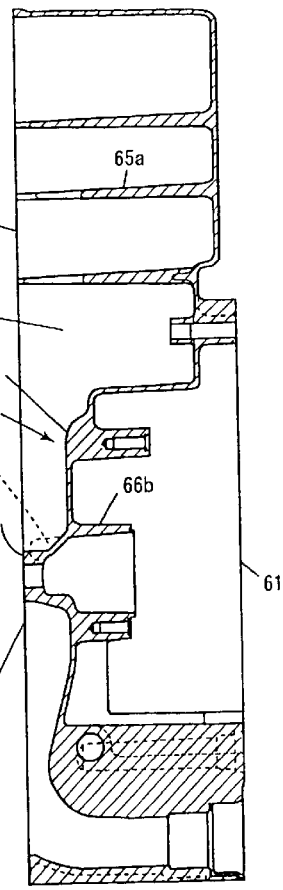

FIG. 4 is a view mainly showing the engine 20, which is a partial, enlarged sectional view taken along line IV—IV of FIG. 1 (with parts partially omitted). FIG. 5 is a right side view of the engine 20. FIG. 6 is a left side view of the engine 20. FIG. 7 is a perspective view of the engine 20 as seen from an obliquely rearward direction and FIG. 8 is an enlarged view of a portion shown in FIG. 5.

The engine 20 is a DOHC type, in-line, four-cylinder/four-cycle engine, which is particularly of a dry sump type according to a preferred embodiment. As shown in FIGS. 1 and 5, a crankshaft 21 of the engine 20 extends along the longitudinal direction of the watercraft body 11. As shown in FIGS. 4 and 7, a surge tank (intake chamber) 22 in communication with an intake port and an inter-cooler 23 connected to the surge tank 22 are disposed on the left side of the engine 20 as seen in the running direction of the watercraft body 11. An exhaust manifold 24 (see FIG. 6), which is connected and in communication with exhaust ports 20*o*, is disposed on the right side of the engine 20.

As shown in FIGS. 6 and 7, a turbo-charger 25 is disposed at the back of the engine 20. An exhaust outlet 24*o* of the exhaust manifold 24 is connected to a turbine portion 25T of the turbo-charger 25. An inter-cooler 23 is connected to a compressor portion 25C of the turbo-charger 25 via piping 26 (see FIG. 7). In FIG. 7, cooling hoses 23*a*, 23*b* are connected to the inter-cooler 23.

After being used for rotating a turbine in the turbine portion 25T of the turbocharger 25, as shown in FIGS. 1 and 2, an exhaust gas passes through piping 27*a*, a counter-flow preventing chamber 27*b* for preventing counter-flow upon turn-over of the watercraft body 11 (permeation of water into the turbo-charger 25, etc.), a water muffler 27*c*, and an exhaust/drainage pipe 27*d*, and flows in a water stream caused by a jet pump 30.

As shown in FIGS. 4 to 8, in a front portion of the engine 20 as seen in the running direction of the watercraft body 11 (equivalent to a left portion in FIGS. 1 and 5), an oil tank 50 and an oil pump 80 integrated with the oil tank 50 are provided on an extension of the crankshaft 21. The oil pump 80 is provided in the oil tank 50. The oil tank 50 includes a tank main body (one divided case) 60 joined to a front plane of the engine 20, and a cover (the other divided case) 70 joined to a front plane of the tank main body 60.

Figure 10:
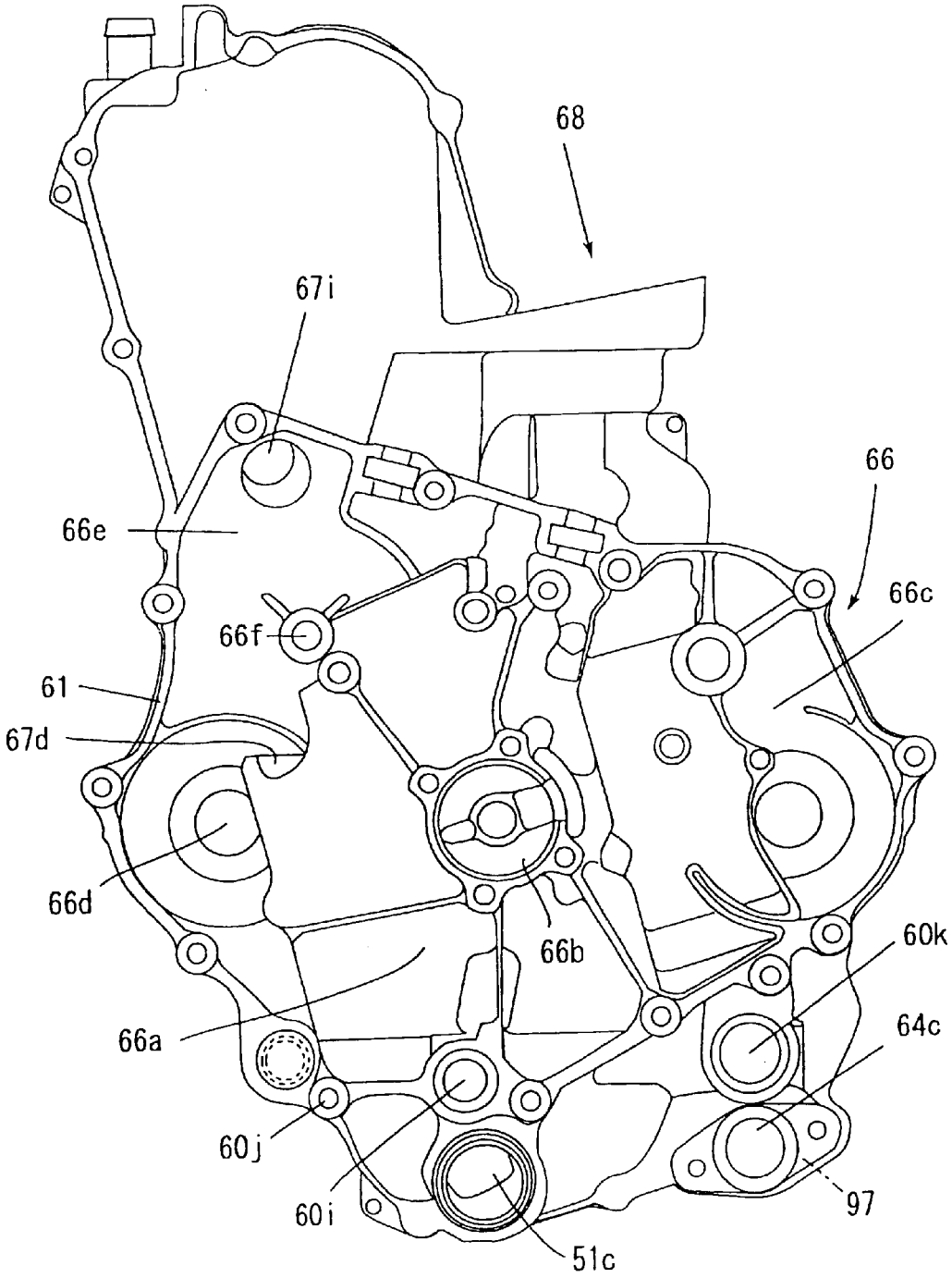
FIG. 10 is a rear view of the tank main body 60.
Figure 11E:
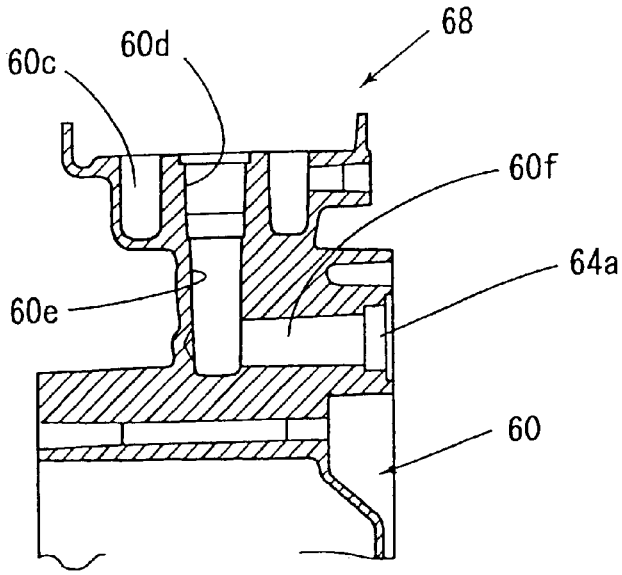
FIG. 11(*e*) is a sectional view taken along line e—e of FIG. 9(*b*) and FIG. 11(*f*) is a sectional view taken along line f—f of FIG. 9(*b*)
Figure 11F:
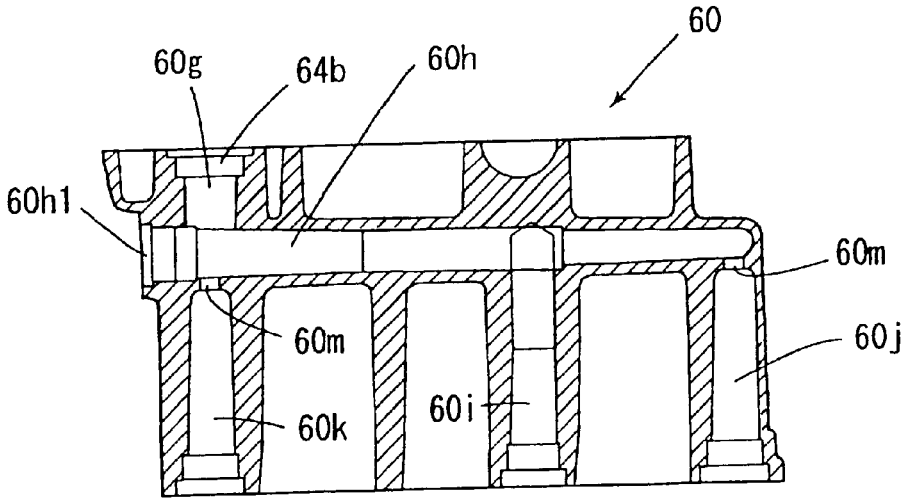
Figure 13B:
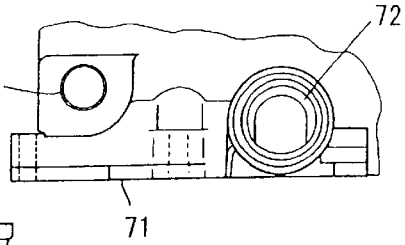
FIGS. 13(*a*) to 13(*c*) are views showing a cover 70, wherein FIG. 13(*a*) is a rear view, FIG. 13(*b*) is a view taken along a direction shown by an arrow "b" in FIG. 13(*a*), and FIG. 13(*c*) is a sectional view taken along line c—c of FIG. 13(*a*)
Figure 13A:
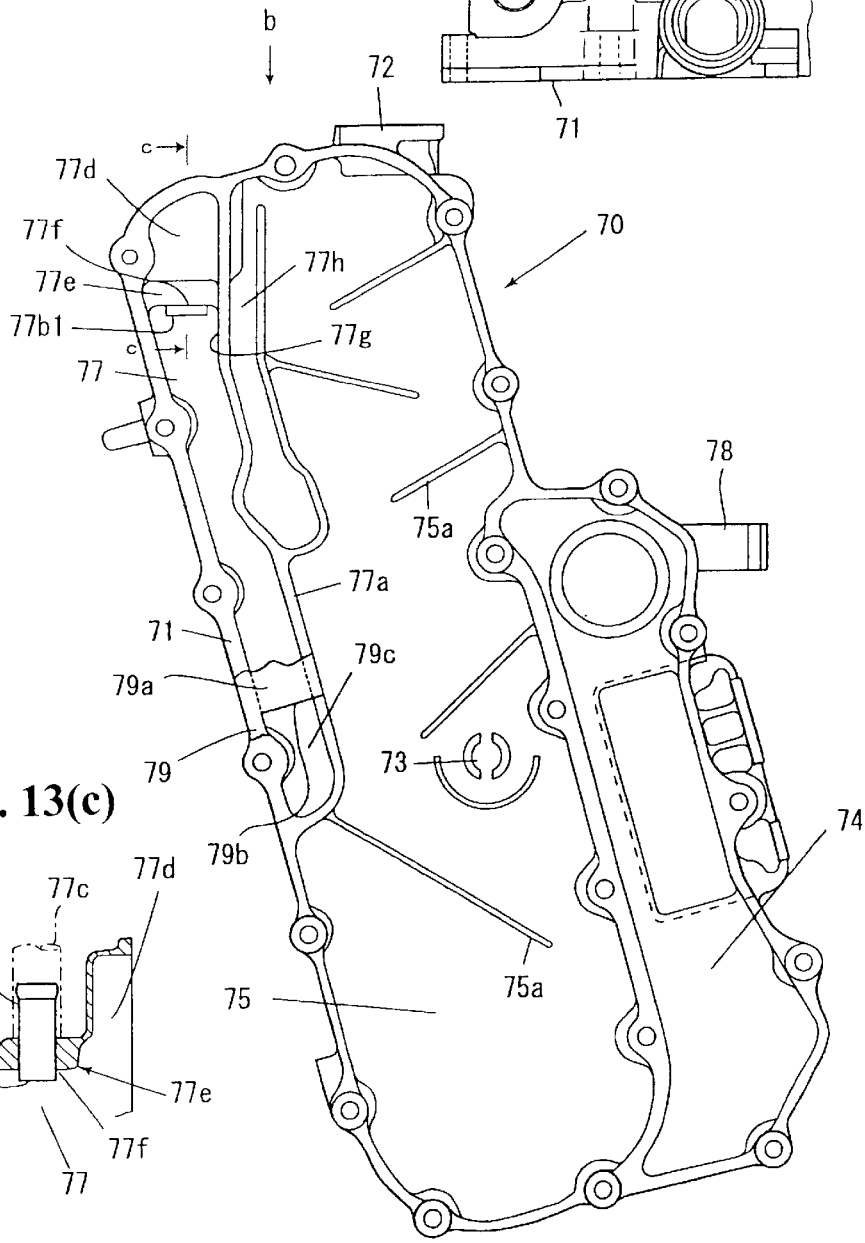
Figure 13C:
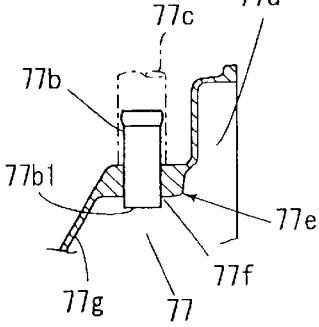
Figure 14:
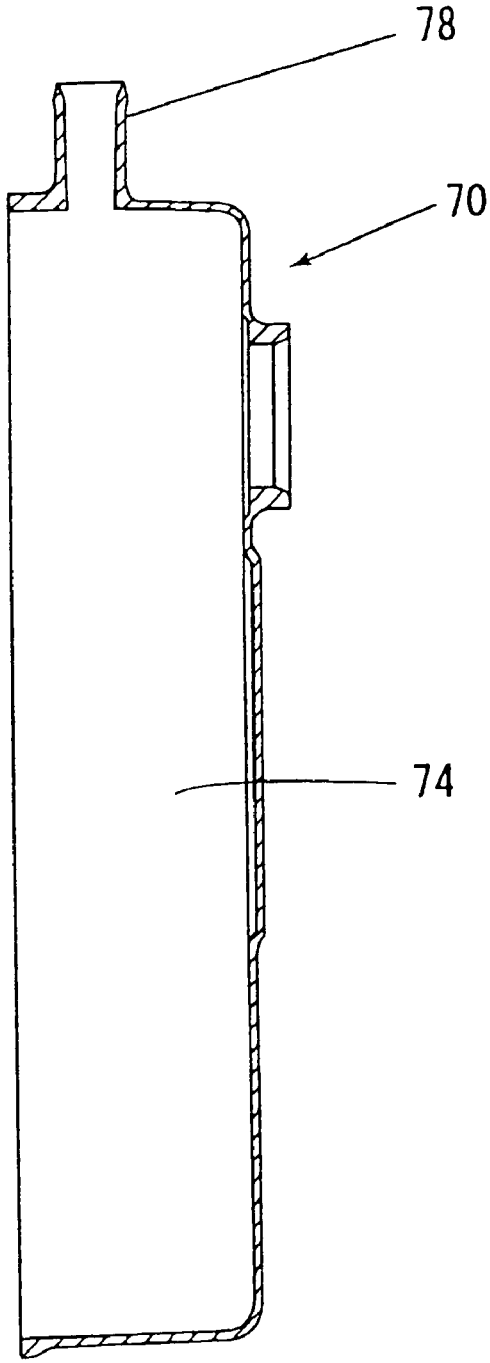
FIG. 14 is a sectional view taken along line XIV—XIV of FIG. 12(*a*)
Figure 15:
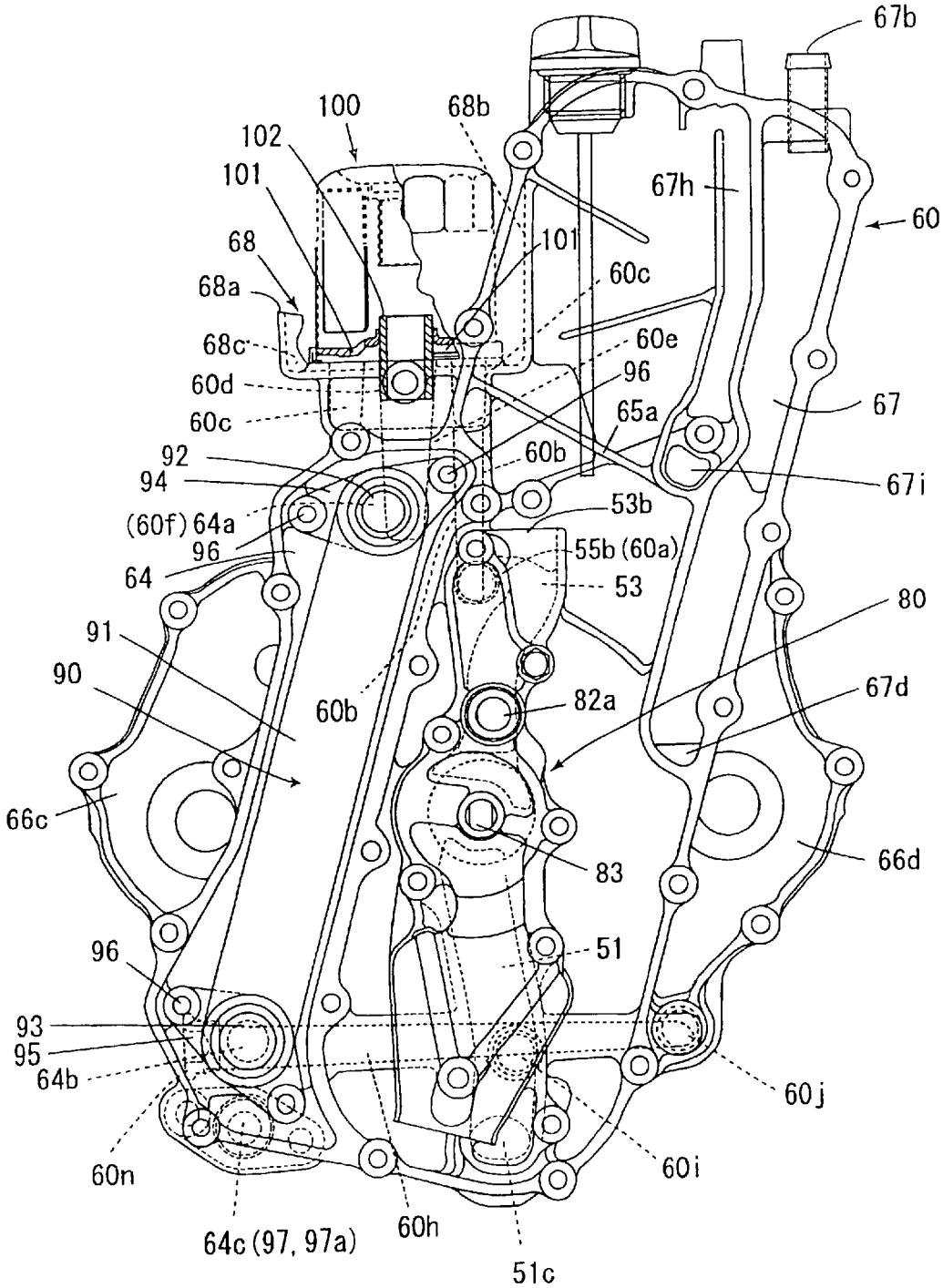
FIG. 15 is an enlarged view of a portion shown in FIG. 4.

FIGS. 9(*a*) to 9(*d*) are views showing the tank main body 60, wherein FIG. 9(*a*) is a plan view, FIG. 9(*b*) is a front view, FIG. 9(*c*) is a sectional view taken along line c—c of FIG. 9(*b*), and FIG. 9(*d*) is a sectional view taken along line b—b of FIG. 9(*a*); FIG. 10 is a rear view of the tank main body 60. FIG. 11(*e*) is a sectional view taken along line e—e of FIG. 9(*b*) and FIG. 11(*f*) is a sectional view taken on line f—f of FIG. 9(*b*). FIGS. 12(*a*) to 12(*d*) are views showing the cover 70, wherein FIG. 12(*a*) is a front view, FIG. 12(*b*) is a sectional view taken along line b—b of FIG. 12(*a*), FIG. 12(*c*) is a sectional view taken along line c—c of FIG. 12(*a*), and FIG. 12(*d*) is a sectional view taken along line d—d of FIG. 12(*a*). FIGS. 13(*a*) to 13(*c*) are views showing the cover 70, wherein FIG. 13(*a*) is a back view, FIG. 13(*b*) is a view seen in the direction shown by an arrow "b" in FIG. 13(*a*), and FIG. 13(*c*) is a sectional view taken along line c—c of FIG. 13(*a*). FIG. 14 is a sectional view taken along line XIV—XIV of FIG. 12(*a*). FIG. 15 is an enlarged view of a portion shown in FIG. 4.

As seen in FIGS. 9 and 10, the tank main body 60 includes a contact plane 61 joined to the front plane of the engine 20, a contact plane 62 jointed with the cover 70, a mounting plane 63 on which the oil pump 80 is mounted, a mounting portion 64 on which a water-cooled type oil cooler 90 (to be described later) is mounted, an oil storing portion 65 which is defined by partition walls forming the mounting planes and outer walls and is formed into a vertically-elongated shape as a whole, a cover portion 66 for covering drive chambers for an ACG to be described later, a balancer shaft, and a starter motor. The tank main body 60 also includes a first sub-breather chamber 67 (to be fully described later) and a mounting portion 68 on which an oil filter 100 (to be described later) is mounted.

A plurality of baffle plates 65*a* are formed in the oil storing portion 65. As seen in FIGS. 5 and 8 (particularly to FIG. 8), reference numeral 110 denotes an ACG rotor, which is fixed, together with a coupling 111, to a leading end of the crankshaft 21 with a bolt 112. The coupling 111 is coupled to a coupling 89 fixed to a rear end of a pump shaft to be described later.

As seen in FIGS. 4, 5 and 8, a balancer driving gear 133 is fixed to a back surface of the ACG rotor 110. As shown in FIG. 4, the gear 113 is meshed, via an idle gear 116, with a balancer gear 115 fixed to a leading end of a balancer 114R (see FIG. 6) disposed in parallel to the crankshaft 21 on the right side in the engine 20 (left side in FIG. 4), so that the gear 113 can rotate the balancer 114R. The gear 113 is also directly meshed with a gear 117 fixed on a leading end of a balancer 114L disposed in parallel to the crankshaft 21 on the left side in the engine 20 (right side in FIG. 4), so that the gear 113 can rotate the balancer 114L in a direction reversed to the rotating direction of the balancer 114R.

In FIG. 4, a starter motor 120 is provided with a pinion gear 121 meshed with a starter gear 123 via a reduction gear 122. The starter gear 123 is, as shown in FIG. 8, connected to the crankshaft 21 via a one-way clutch 124. As seen in FIGS. 8, 9 and 10, the cover portion 66 of the tank main body 60 has an ACG cover portion 66*a* for covering the ACG rotor 110, the balancer driving gear 113, a starter gear 123, a coupling cover portion 66*b* for covering the coupling 111 portion, a right balancer driving system cover portion 66*c* for covering the balancer gear 115 and the idle gear 116. A left balancer driving system cover portion 66*d* for covering the balancer gear 117, and a starter driving system cover portion 66*e* for covering the pinion gear 121 of the starter motor 120 and the reduction gear 122 are also provided as shown. In these figures, a hole 66*f* for supporting a shaft of the reduction gear 122 is also shown.

In FIG. 8, a pulser 118 is provided on an outer periphery of the ACG for taking out a pulse signal. In the ACG cover portion 66*a*, the pulser 118 is mounted on the coupling cover portion 66*b*. Accordingly, the pulser 118 overlaps the oil tank 50 with respect to the axial direction of the crankshaft 21. The tank main body 60 configured as described above is joined to the front plane of the engine 20 at its contact plane 61 in a state that the above-described portions of the tank main body 60 are covered with the cover portion 66. The tank main body 60 is integrally fixed to the front plane of the engine 20 with bolts (not shown). After the oil pump 80 and the oil cooler 90 to be described later are mounted to the tank main body 60, the tank main body 60 is mounted to the front plane of the engine 20.

As seen in FIGS. 12 to 14, the cover 70 includes a contact plane 71 joined to the tank main body 60, an oil supply port 72, a pressing portion 73 for pressing a relief valve (to be described later), an oil cooler accommodating portion 74 for accommodating the oil cooler (to be described later), an oil storing portion 75 defined by the outer wall and partition walls, and the second sub-breather chamber 77 (to be fully described later). A plurality of baffle plates 75*a* are formed in the oil storing portion 75.

Figure 16A:
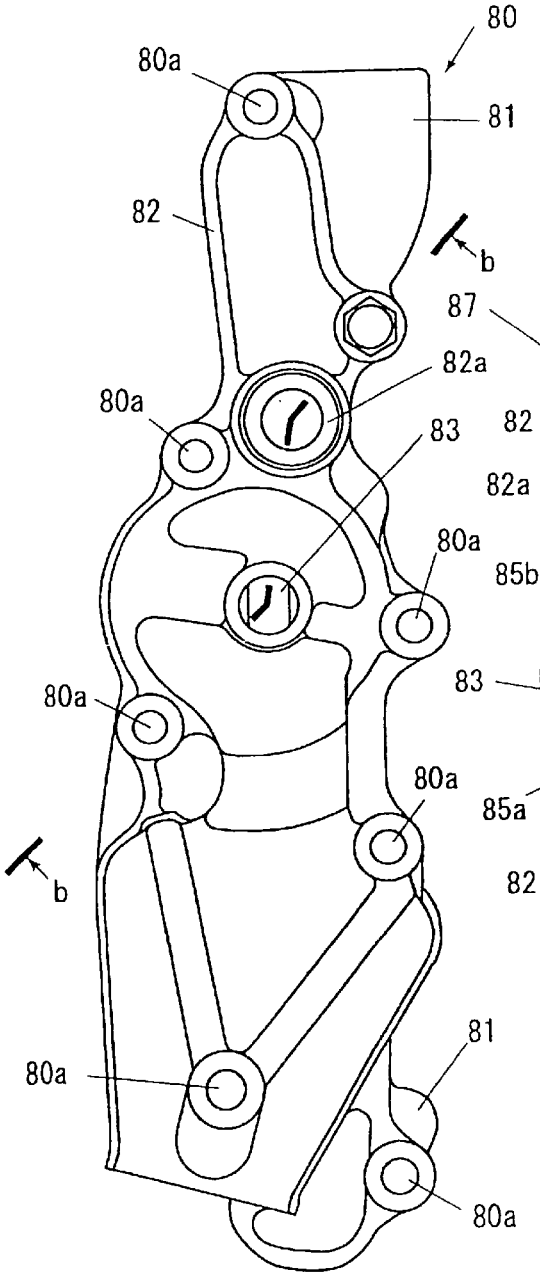
FIGS. 16(*a*) and 16(*b*) are views showing an oil pump 80, wherein FIG. 16(*a*) is a front view and FIG. 16(*b*) is a sectional view taken along line b—b of FIG. 16(*a*)
Figure 16B:
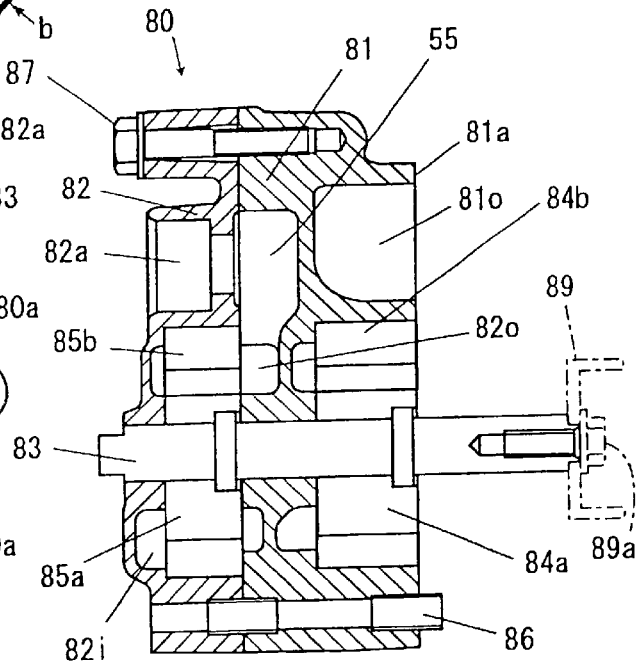

FIGS. 16(*a*) and 16(*b*) are views showing the oil pump 80, wherein FIG. 16(*a*) is a front view and FIG. 16(*b*) is a sectional view taken on line b—b of FIG. 16(*a*). As seen in FIGS. 16(*a*) and 16(*b*) and FIG. 8, the oil pump 80 includes a first case 81 joined to the tank main body 60, a second case 82 jointed to the first case 81, and a pump shaft 83 provided so as to pass through the first and second cases 81 and 82. An oil recovery inner rotor 84*a* connected to the pump shaft 83 in the first case 81, an outer rotor 84*b* rotatably provided on the outer periphery of the inner rotor 84*a*, an oil supply inner rotor 85*a* connected to the pump shaft 83 in the second case 82, and an outer rotor 85*b* rotatably provided on the outer periphery of the inner rotor 85*a* are also provided as shown. A dowel pin 86 is also shown in the figures.

The oil recovery inner rotor 84*a* and the outer rotor 84*b* form an oil recover pump in cooperation with the first case 81, and the oil supply inner rotor 85*a* and the outer rotor 85*b* form an oil supply pump in cooperation with the first and second cases 81 and 82. The oil pump 80 is assembled as shown in FIGS. 16(*a*) and 16(*b*) and the first case 81 is connected to the second case 82 with a bolt 87. The contact plane 81*a* to be joined to the tank main body 60 of the first case 81 is joined to the contact plane 69 (see FIGS. 9(*a*) and 9(*b*)). The contact plane 69 has the same shape as that of the contact plane 81*a* and is formed on the front plane of the oil tank main body 60. A bolt 88 (see FIG. 8) is inserted in a hole 80*a* passing through the first and second cases 81 and 82, whereby the oil pump 80 is mounted to the front plane of the tank main body 60.

After the oil pump 80 is mounted to the tank main body 60, a coupling 89 is fixed, from the rear surface side of the tank main body 60, to a rear end of the pump shaft 83 with a bolt 89*a*. After the oil pump 80 and its coupling 89 are mounted to the tank main body 60, the oil cooler 90 is mounted to the tank main body 60. Next, the tank main body 60 is mounted to the front plane of the engine 20 in such a manner that the coupling 89 is coupled to the coupling 111 as described above.

As seen in FIGS. 6 and 9(*b*), the water-cooled type oil cooler 90 is mounted to the front surface side of the oil cooler 90 mounting portion 64 of the tank main body 60. The mounting portion 64 of the tank main body 60 has an upper hole 64*a* and a lower hole 64*b* in communication with an oil passage to be described later. As shown in FIG. 6, the oil cooler 90 has a plurality of heat exchange plates 91 allowing oil to pass therethrough. An oil inlet pipe 92 in communication with the insides of upper portions of the plates 91, an oil outlet pipe 93 in communication with the insides of lower portions of the plates 91, and flange portions 94 and 95 for mounting the oil cooler 90 to the tank main body 60 are also provided as shown.

The oil cooler 90 is mounted to the mounting portion 64 of the tank main body 60 by fastening the flange portions 94 and 95 to the tank main body 60 with bolts (not shown) in a state that the inlet pipe 92 is connected to the upper hole 64*a* of the tank main body 60. The outlet pipe 93 is connected to the lower hole 64*b* of the tank main body 60. In FIG. 15, a bolt insertion hole 96 is provided in each of the flange portions 94 and 95.

A cooling water introduction pipe 97 in communication with a hole 64*c* (see FIG. 15) opening in the mounting portion 64 for introducing cooling water in the mounting portion 64 and the oil cooler accommodating portion 74 of the cover 70 is provided in the tank main body 60. The cover 70 is provided with a water discharge pipe 78 as shown in FIGS. 12(*a*) to 12(*d*), FIGS. 13(*a*) to 13(*c*), and FIG. 14. A cooling water hose 97*a* from a cooling water takeoff portion 30*a* (see FIG. 7) of the jet pump 30 is connected to the introduction pipe 97 directly, e.g., without interposition of any cooling object therebetween. A drainage pipe 23*c* is, as shown in FIG. 6, connected to the discharge pipe 78. Water from the drainage pipe 78 is supplied to a water jacket of the exhaust manifold 24 via the drainage pipe 23*c*.

After the tank main body 60 is mounted, the oil pump 80 and the oil cooler 90 are mounted on the front plane of the engine 20 as described above. As shown in FIG. 8 and FIGS. 16(*a*) and 16(*b*), a rear end 131 of a relief valve 130 is fitted in a hole 82*a* formed in a front plane of the second case 82 of the oil pump 80. The cover 70 is joined to a front plane of the tank main body 60 in such a manner that a leading end 132 of the relief valve 130 is pressed by the above-described pressing portion 73 and the cover 70 is fixed to the tank main body 60 with bolts (not shown). In FIG. 12(*a*), each of a plurality of bolt insertion holes 76 allowing the bolts for fixing the cover 70 to the tank main body 60 to pass therethrough is provided as shown. As is apparent from FIG. 8, the relief valve 130 is horizontally disposed in a preferred embodiment.

When the cover 70 is joined to the tank main body 60, a single vertically-elongated oil storing portion is formed by both the oil storing portions 65 and 75. Further, by joining the cover 70 to the tank main body 60, the baffle plates 65*a* and 75*a* are formed in both the oil storing portions in such a manner as to be opposed to and joined to each other. An oil filter 100 is mounted to the oil filter 100 mounting portion 68 of the tank main body 60. In a state that the engine 20 is mounted on the watercraft body 11, the engine 20 and the oil filter 100 are aligned with an opening 15*a* of the deck 15 as shown in FIGS. 2 and 4. The opening 15*a* of the deck 15 is opened by removing the seat 12, which is removably mounted on the watercraft body 11.

In a state that the oil tank 50 (including the tank main body 60, the cover 70, and the oil pump 80, the oil cooler 90 and the relief valve 130 contained in the cover 70) is mounted to the front plane of the engine 20 and the oil filter 100 is mounted to the mounting portion 68 of the tank main body 60 as described above, the following oil passages are formed. As seen in FIGS. 5 and 8, an oil recovery passage 51 is formed between the front plane of the tank main body 60 and the back surface of the first case 81 of the oil pump 80. The recovery passage 51 includes an oil passage 51*a* (see FIG. 9(*b*)) formed on the tank main body 60 side, and an oil passage 51*b* which is formed in a portion on the first case 81 side of the oil pump 80 in such a manner as to be opposed to the oil passage 51*a*.

A lower end 51*c* of the oil recovery passage 51 is in communication with an oil pan 28 of the engine 20 via a pipe 52. An upper end 51*d* of the oil recovery passage 51 is in communication with a recovery oil suction port 81*i* formed in a portion, on the first case 81 side, of the oil pump 80. Similarly, a recovery oil discharge passage 53 between the front plane of the tank main body 60 and the rear surface of the first case 81 of the oil pump 80 is also formed. The recovery oil discharge passage 53 includes an oil passage 53*a* (see FIG. 9(*b*)) formed on the tank main body 60 side, and a recovery oil discharge port 81*o* which is formed in a portion on the first case 81 side of the oil pump 80 in such a manner as to be opposed to the oil passage 53*a*. An upper end 53*b* of the recovery oil discharge passage 53 is opened in the oil tank 50 (that is, in the oil storing portions) (see FIGS. 9(*b*) and 15).

As seen in FIG. 8, a supplied oil suction passage 54 and a supplied oil discharge passage 55 are formed between the front plane of the first case 81 of the oil pump 80 and the back surface of the second case 82 of the oil pump 80. A lower end 54*a* of the suction passage 54 is opened in the oil tank 50 (that is, in the oil storing portions), and an upper end 54*b* of the suction passage 54 is in communication with a supplied oil suction port 82*i* of an oil supply pump (see FIG. 16(*b*)). A screen oil filter 54*c* is provided in the suction passage 54.

A lower end 55*a* of the discharge passage 55 is in communication with a supplied oil discharge port 82*o* of the oil supply pump. An upper end 55*b* of the discharge passage 55 passes through an upper portion of the first case 81 in the horizontal direction, to be in communication with a horizontal hole 60*a* formed in the tank main body 60 (see FIGS. 9(*b*) and 15). As shown in FIGS. 8, 9(*b*) and 15, the horizontal hole 60*a* is in communication with a vertical hole 60*b* formed in the tank main body 60. An upper end 60*c* of the vertical hole 60*b* is opened in the oil filter 100 mounting portion 68 (see FIGS. 9(*a*) and 11(*e*)) in such a manner as to be formed into a ring-shape in a plan view. An oil flow-in passage 101 of the oil filter 100 is in communication with the upper end 60*c* of the vertical hole 60*b*.

The above-described relief valve 130 mounting hole 82*a* is opened in the discharge passage, and the relief valve 130 is mounted in the mounting hole 82*a* as described above. A male screw is provided in an oil outlet pipe 102 in the oil filter 100. The oil filter 100 is mounted to the mounting portion 68 of the tank main body 60 by screwing the male screw portion of the oil outlet pipe 102 in a female thread hole 60*d* formed in the mounting portion 68 of the tank main body 60 (see FIGS. 9(*a*), 9(*b*), 11(*e*) and 15).

A peripheral wall 68*a* is formed integrally with the mounting portion 68. An oil receiving portion 68*c* is formed by the peripheral wall 68*a* and a side wall surface 68*b*, continuous to the peripheral wall 68*a*, of the tank main body 60. Accordingly, if oil is dropped from the oil filter 100 when the oil filter 100 is mounted or dismounted to or from the mounting portion 68, then it is received on the oil receiving portion 68*c* and is returned into the oil tank via the female thread hole 60*d* or the opening 60*c*. As a result, the inside of the watercraft body 11 is less contaminated by the oil dropped from the oil filter 100.

As seen in FIGS. 9(*a*), 9(*b*), 11(*e*) and 15, a vertical hole 60*e* and a horizontal hole 60*f* in communication with a lower end of the vertical hole 60*e* are formed in a lower portion of the female thread hole 60*d*, and the horizontal hole 60*f* is in communication with the inlet pipe 92 of the oil cooler 90 via the upper hole 64*a* formed in the oil cooler 90 mounting portion 64 (see FIGS. 6 and 15).

As described above, the outlet pipe 93 of the oil cooler 90 is connected to the lower hole 64*b* of the tank main body 60. As seen in FIG. 11(*f*), an oil passage 60*g* in communication with the lower hole 64*b* and an oil distribution passage 60*h* in communication with the passage 60*g* are formed in the lower hole 64*b*. The oil distribution passage 60*h* is in communication with three passages: a main gallery oil supply passage 60*i* for supplying oil to a main gallery 20*a* of the engine 20 (see FIG. 5), a left balancer oil supply passage 60*j* for supplying oil to a bearing portion of the left balancer 114L, and a right balancer oil supply passage 60*k* for supplying oil to a bearing portion of the right balancer 114R.

Figure 17:
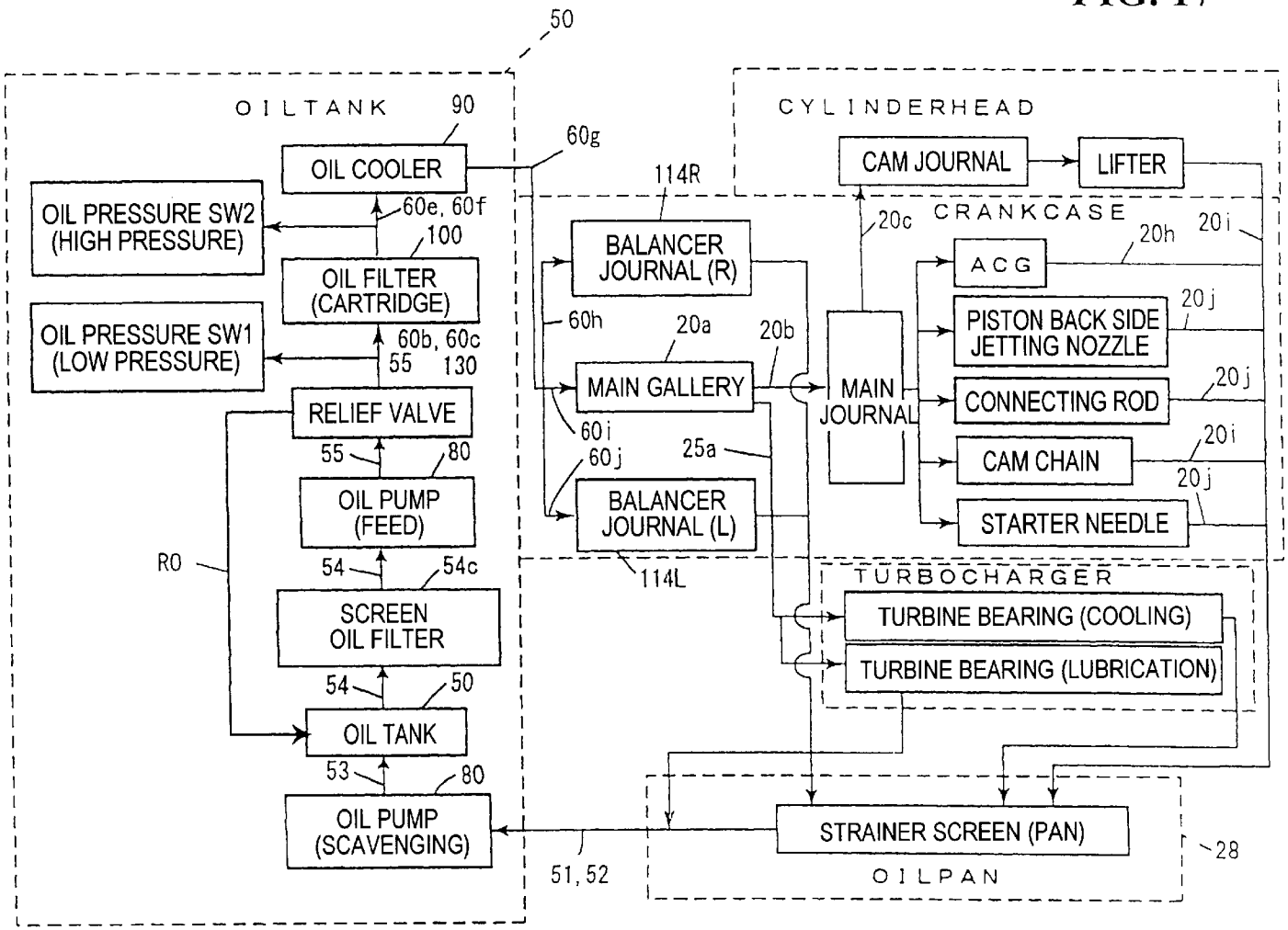
FIG. 17 is a diagram showing an oil circulation route according to the present invention.

Each of the oil supply passages 60*j* and 60*k* for the balancers 114L and 114R is in communication with an oil distribution passage 60*h* via a narrow passage 60*m*. One end 60*h*1 of the oil distribution passage 60*h* is closed with a plug 60*n* (see FIG. 6). A route of oil supplied to the main gallery 20*a* of the engine 20 is as shown in FIG. 17 (which is an oil circulation route diagram).

The route of oil supplied to the main gallery 20*a* is basically classified into two routes. The first route extends from a route 20*b* (see FIG. 5) to a bearing portion of the crankshaft (main journal) 21. Oil is supplied to the bearing portion of the crankshaft 21 via such a first route. The second route extends from a rear end 20*a*1 of the main gallery 20*a* to a turbine bearing portion of the turbo-charger 25 via a pipe 25*a* (see FIG. 7). Oil is supplied to the turbine bearing portion of the turbo-charger 25 via such a second route for cooling and lubricating the turbine bearing portion. The oil, which has been used for cooling and lubricating the turbine bearing portion of the turbo-charger 25, is recovered to the oil pan 28 via pipes 25*b* and 25*c* (see FIG. 6).

The oil, which has been supplied to the bearing portion of the crankshaft 21, is then supplied to a cam journal 20*d* portion and a lifter portion of a cylinder head via a route 20*c* (see FIG. 5) for lubricating the cam journal 20*d* portion and the lifter portion, and is returned to the oil pan 28 via a chain chamber 20*i*.

The oil, which has been supplied to the bearing portion of the crankshaft 21, is then supplied to the ACG, a piston back side jetting nozzle, a connecting rod, a cam chain, and a starter needle, and is returned to the oil pan 28 via the corresponding recovery passages. In FIG. 5, reference numeral 20*e* denotes a jet nozzle for jetting oil to the back side of the piston for cooling the piston; 20*f* is a passage in communication with the connecting rod portion; 20*g* is a cam chain; and 20*h* is a return passage for returning oil from an ACG chamber 10*c*.

The oil, which has been supplied to the ACG chamber 110*c*, is returned to the oil pan 28 via the return passage 20*h*. The oil having been used to be jetted from the jet nozzle 20*e* to the back side of the piston, the oil having been supplied to the connecting rod, and the oil having been supplied to the starter needle are each returned to the oil pan 28 via a crank chamber 20*j*.

As is apparent from the above description, referring mainly to FIG. 17, the general flow of oil is as follows: Oil tank 50→suction passage 54→screen oil filter 54*c*→oil pump (supply pump) 80→discharge passage 55 (and relief valve 130, horizontal hole 60*a*, vertical hole 60*b*, and ring-shaped opening 60*c*)→oil filter 100→vertical hole 60*e* and horizontal hole 60*f*→oil cooler 90→oil passage 60*g* and oil distribution passage 60*h*→main gallery oil supply passage 60*i*, left balancer oil supply passage 60*j* and right balancer oil supply passage 60*k*→main gallery 20*a*, left balancer 114L and right balancer 114R. The relief oil, denoted by character RO, flowing from the relief valve 130 is directly returned to the inside of the oil tank 50.

The oil, which has been supplied to the left balancer 114L and the right balancer 114R, is returned to the oil pan 28 via the crank chamber 20*j*. The oil, which has been supplied from the main gallery 20*a* to the above-described respective portions, is returned to the oil pan 28 as described above. The oil thus returned to the oil pan 28 is the recovered to the oil tank 50 via the pipe 52, the oil recovery passage 51, the oil pump (recovery pump) 80, and the recovery oil discharge passage 53, and is circulated again from the suction passage 54 to the above-described portions by way of the above-described routes.

As described above, the first sub-breather chamber 67 is formed in the tank main body 60 and the second sub-breather chamber 77 is formed in the cover 70. As shown in FIG. 9(*b*), the first sub-breather chamber 67 is partitioned from the oil storing portion 65 of the tank main body 60 by means of a partition wall 67*a*, and as shown in FIG. 13(*a*), the second sub-breather chamber 77 is partitioned from the oil storing portion 75 of the cover 70 by means of a partition wall 77*a*. Each of the sub-breather chambers 67 and 77 is formed into a vertically-elongated shape.

The contact plane 62 of the tank main body 60 is jointed to the contact plane 71 of the cover 70 via a metal gasket 79, part of which is shown in FIG. 13(*a*). The metal gasket 79 has a shape basically matched to the shape of each of the contact planes 62 and 71; however, the metal gasket 79 extends inwardly in each of the first sub-breather chamber 67 and the second sub-breather chamber 77. The extending portion, which is denoted by reference numeral 79*a*, of the metal gasket 79 is configured as a partition plate for partitioning the first sub-breather chamber 67 and the second sub-breather chamber 77 from each other. It is to be noted that the extending portion 79*a* does not perfectly partition the first sub-breather chamber 67 and the second sub-breather chamber 77 from each other. Concretely, a space under a lower end 79*b* of the metal gasket 79 is opened and the first sub-breather chamber 67 and the second sub-breather chamber 77 are in communication with each other via such an opening portion, which is denoted by reference numeral 79*c*.

A breathing passage 67*h* is formed in the oil storing portion of the tank main body 60 at a position adjacent to the first sub-breather chamber 67 (see FIG. 9(*b*)). Similarly, a breathing passage 77*h* is formed in the oil storing portion of the cover 70 at a position adjacent to the second sub-breather chamber 77 (see FIG. 13(*a*)). When the cover 70 is joined to the tank main body 60, these breathing passages 67*h* and 77*h* form a single breathing passage. A lower end of the breathing passage 67*h* on the tank main body 60 side is in communication with the inside of the cover portion 66 via an opening 67*i* (see FIG. 10). Accordingly, the oil storing portion of the oil tank 50 also has a breathing function.

As seen in FIGS. 9(*a*) to 9(*d*), a breathing gas inlet pipe 67*b* in communication with the first sub-breather chamber 67 is provided in an upper portion of the first sub-breather chamber 67. On the other hand, as shown in FIG. 4, a main breathing chamber 29*a* is formed in a head cover 29 of the engine 20. To make the entire height of the engine 20 as low as possible, the volume of the main breathing chamber 29*a* in the head cover 29 is made as small as possible. A breathing gas outlet pipe 29*b* is provided in the head cover 29, and the outlet pipe 29*b* is connected to the inlet pipe 67*b* of the first sub-breathing chamber 67 via a breather pipe 67*c*.

As seen in FIGS. 12(*a*) and 13, a breathing gas outlet pipe 77*b* in communication with the second sub-breather chamber 77 is provided in an upper portion of the second sub-breather chamber 77. The outlet pipe 77*b* is provided at a position lower than that of the inlet pipe 67*b* of the first sub-breather chamber 67 (see FIG. 4). The outlet pipe 77*b* is connected, in an intake system of the engine 20, to an intake box (not shown) disposed on the upstream side from the turbo-charger 25 via the breather pipe 77*c* (see FIG. 13(*c*)), to return breathing gas to the intake box.

As seen in FIGS. 8, 9(*a*) and 9(*b*), and 10, a return passage 67*d* for returning oil, which has been separated in the first and second sub-breather chambers 67 and 77, is provided at a lower end of the first sub-breather chamber 67. The return passage 67*d* is formed in the tank main body 60 and is in communication with the ACG chamber 110*c*. Accordingly, the oil, which has been separated in the first and second sub-breather chambers 67 and 77, enters the ACG chamber 110*c* via the return passage 67*d*, and is returned to the oil pan 28 via the above-described return passage 20*h*.

According to the above-described breather structure, at the time of normal operation, a breathing gas generated in the engine 20 enters the main breathing chamber 29*a* in the head cover 29, the first sub-breather chamber 67 via the breather pipe 67*c*, and the second breather chamber 77 via the opening portion 79*c* (communication passage between the first and second sub-breather chambers 67 and 77) provided at the lower end of the first sub-breather chamber 67, and is returned from the outlet pipe 77*b* of the second sub-breather chamber 77 to the intake box via the breather pipe 77*c*.

The oil, which has been separated in the course of passing of the breathing gas through the first and second sub-breather chambers 67 and 77, is returned, as described above, to the oil pan 28 via the return passage 67*d*, the ACG chamber 110*c*, and the return passage 20*h*. By the way, a personal watercraft of this type is mainly used for leisure, and therefore, it may be often turned over.

Figure 18B:
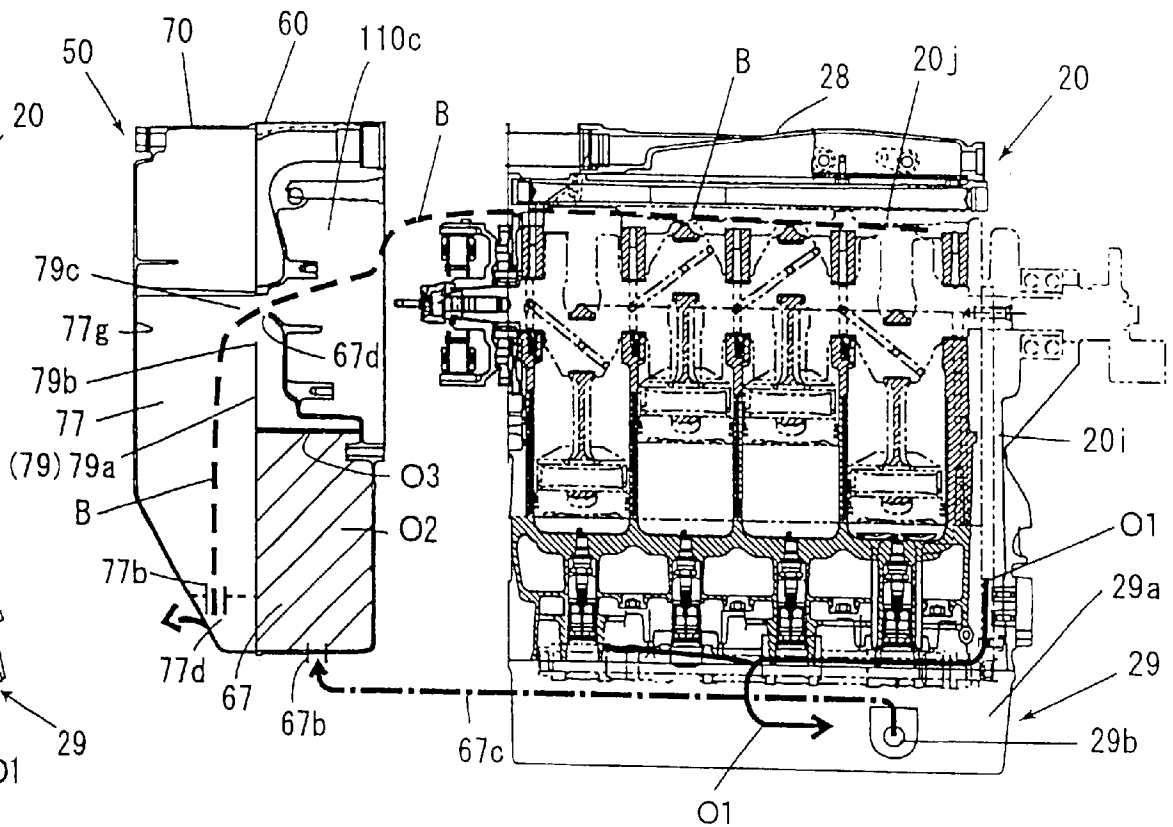
FIGS. 18(*a*) and 18(*b*) are schematic views showing states of an engine 20 and an oil tank 50 during the turn-over condition of a watercraft 10, wherein FIG. 18(*a*) is a front view and FIG. 18(*b*) is a side view.
Figure 18A:
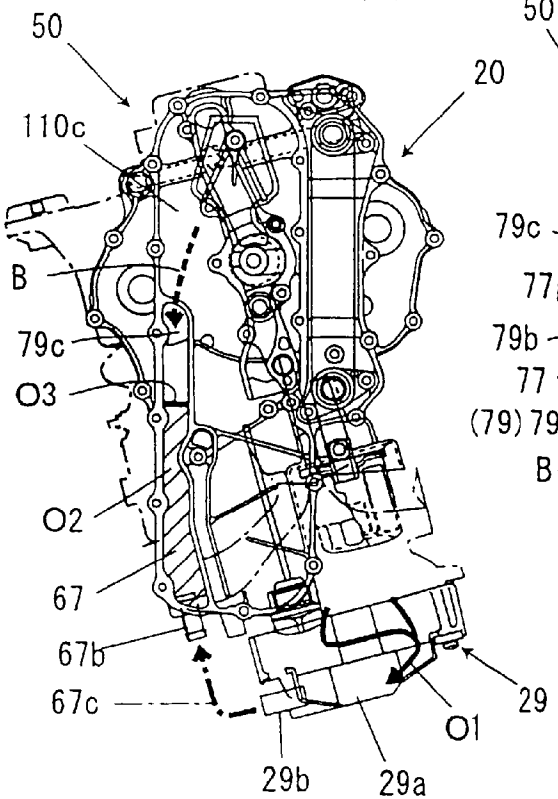

According to the above-described breather structure, however, the flow of oil out of the above-described oil passages provided in the engine 20, the oil tank 50, and the like can be prevented as described below. FIGS. 18(*a*) and 18(*b*) are schematic views showing states of the engine 20 and the oil tank 50 during the turn-over condition of the watercraft 10, wherein FIG. 18(*a*) is a front view, and FIG. 18(*b*) is a side view. It is to be noted that, in order to clarify flows of oil and breathing gas, the engine 20 and the oil tank 50 are depicted as being separated from each other in FIG. 18(*b*).

As shown in the figures, when postures of the engine 20 and the oil tank 50 are vertically reversed by turn-over of the watercraft 10, the oil, which has been present mainly in the crank chamber 20*j* of the engine 20, the oil pan 28, and the like flows down to the main breathing chamber 29*a* as shown by an arrow O1. It is to be noted that the oil, which has been present in the oil pan 28, flows down to the main breathing chamber 29*a* via the chain chamber 20*i*.

Since the volume of the main breathing chamber 29*a* is made as small as possible to make the entire height of the engine as low as possible as described above, only part of the oil in the engine 20 can be stored in the main breathing chamber 29*a*, and the remainder of the oil flows in the first sub-breather chamber 67 via the breather pipe 67*c*. In the figures, character O2 (hatched portion) denotes the oil having flown in the first sub-breather chamber 67, and character O3 denotes an upper plane of the oil (oil level). As shown in the figures, although the oil flows in the first sub-breather chamber 67, it does not flow in the second sub-breather chamber 77 because the second sub-breather chamber 77 is partitioned from the first sub-breather chamber 67 by means of the extending portion 79*a* of the metal gasket 79 as described above (see FIG. 13(*a*)).

In other words, the volume of the first sub-breather chamber 67 and the lower end (upper end during the turn-over condition) of the extending portion 79*a* of the metal gasket 79 are configured such that oil does not flow in the second sub-breather chamber 77 during the turn-over condition. Here, an oil sump portion in the first sub-breather chamber 67 is defined by the inner wall surface of the tank main body 60, the extending portion 79*a* of the metal gasket 79, and the lower end 79*b* (upper end during the turn-over condition) of the extending portion 79*a*, and an oil sump portion in the engine 20 is defined by an engine upper portion (which is mainly formed by the main breathing chamber 29*a* and the cylinder head portion, and which is an engine lower portion during the turn-over condition). The total of the volume of the above oil sump portion in the first sub-breather chamber 67 and the volume of the above oil sump portion in the engine 20 is formed such that oil does not flow in the second sub-breather chamber 77. Accordingly, the total of oil circulating in the engine 20 and the oil tank 50 is set such that oil does not flow in the second sub-breather chamber 77 during the turn-over condition.

Since oil does not flow in the second sub-breather chamber 77 during the turn-over condition of the watercraft 10 as described above, there does not occur a situation that oil flows in the intake box via the second sub-breather chamber 77, the outlet pipe 77*b* thereof, and the breather pipe 77*c* connected to the outlet pipe 77*b*. If oil flows in the breather pipe 77*c* connected to the outlet pipe 77*b* of the second sub-breather chamber 77 during the turn-over condition, then there may occur an inconvenience that as will be described later, oil having flown in the breather pipe 77*c* flows into the intake box when the watercraft 10 is recovered (returned to an original posture), and flows in the watercraft body from the intake box, to contaminate the watercraft body (which results in pollution of an environment such as sea).

On the contrary, according to the breather structure in this embodiment, since there does not occur the situation that oil flows in the breather pipe 77*c* in communication with the intake box, it is possible to prevent the flow of oil out of the oil passages provided in the engine 20, the oil tank 50 and the like, and hence to prevent pollution of an environment.

As described hereinabove, oil is separated from the breathing gas in each of the first and second sub-breather chambers 66 and 77. The separated oil enters the ACG chamber 110*c* via the return passage 67*d* provided at the lower end of the first sub-breather chamber 67 and is returned to the oil pan 28 via the above-described return passage 20*h*. Accordingly, during the turn-over condition of the watercraft 10, the oil having adhered on a water surface 77*g* of the second sub-breather chamber 77, and the oil present at the lower end of the second sub-breather chamber 77 and the return passage 67*d* flows (although the amount of the oil may be slight) to the outlet pipe 77*b* side of the second sub-breather chamber 77. The oil then flows along the inner surface 77*g* of the second sub-breather chamber 77.

According to this embodiment, as shown in FIGS. 13(*a*) to 13(*c*), an oil sump portion 77*d* for accumulating oil during the turn-over condition is provided in the upper portion (lower portion during the turn-over condition) of the second sub-breather chamber 77 to cope with such an inconvenience. The oil sump portion 77*d* is formed so as to be stepped up from an opening portion 77*b*1, opened in the second sub-breather chamber 77, of the outlet pipe 77*b* via a stepped portion 77*e*. The opening portion 77*b*1 projects from a lower surface 77*f* (upper surface, during the turn-over condition) of the stepped portion 77*e* in such a manner as not to be brought into contact with the inner wall surface 77*g* of the second sub-breather chamber 77.

Accordingly, even if during the turn-over condition, the oil having adhered on the wall surface of the second sub-breather chamber 77 and the oil having being present at the lower end of the second sub-breather chamber 77 and in the return passage 67*d* flow to the outlet pipe 77*b* side and flow along the inner wall surface 77*g* of the second sub-breather chamber 77, then the oil is received and accumulated in the oil sump portion 77*d*, and therefore, the oil does not flow in the outlet pipe 77*b*.

As a result, it is possible to more certainly prevent the flow of oil in the watercraft body 10. On the other hand, even during the turn-over condition, the engine 20 may be sometimes in a state being continuously rotated. The engine 20 may be often rotated at least immediately after the watercraft 10 is turned over.

If something is not done about such circumstances, then there may occur the above-described inconvenience that the oil, which has flown from the main breathing chamber 29*a* to the first sub-breather chamber 67, overflows the lower end 79*b* (upper end, during the turn-over condition) of the extending portion 79*a* of the metal gasket 79 to the second sub-breather chamber 77 by a pressure of breathing gas gradually increased in the engine 20.

According to this embodiment, however, during the turn-over condition, a breathing passage shown by a broken line B in FIGS. 18(*a*) and 18(*b*) is formed, which route extends from the inside of the crank chamber 20*j* to the intake box via the ACG chamber 110*c*, the return passage 67*d*, the opening portion 79*c* of the metal gasket 79, the second sub-breather chamber 77, the outlet pipe 77*b* thereof, and the breather pipe 77*c*. That is to say, the return passage 67*d* form the breathing route during the turn-over condition of the watercraft 10.

Figure 19B:
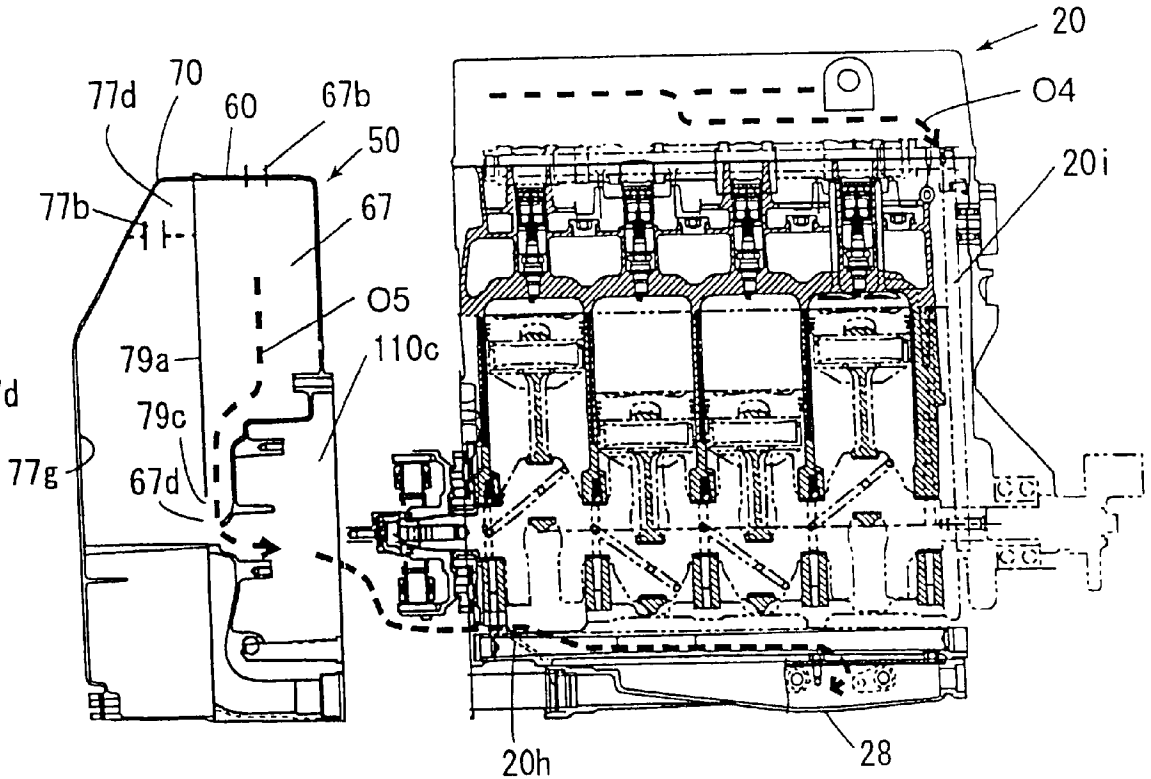
FIGS. 19(*a*) and 19(*b*) are views illustrating a return of oil when the turned-over watercraft 10 is recovered (returned to a normal posture), wherein FIG. 19(*a*) is a front view and FIG. 19(*b*) is a side view.
Figure 19A:
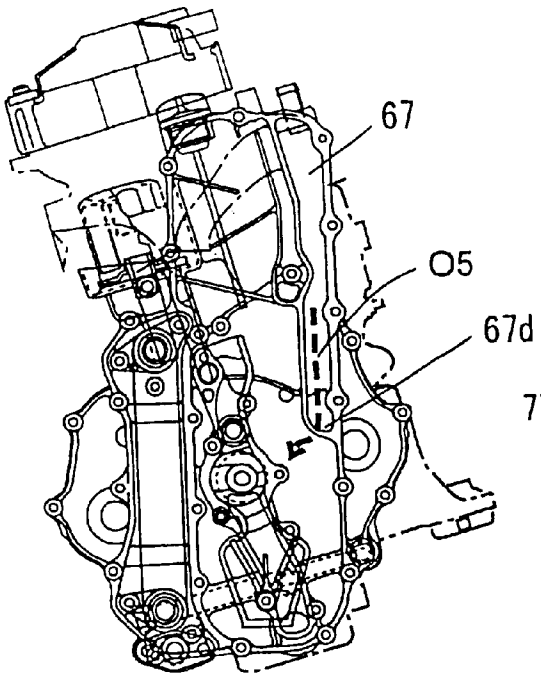

As a result, according to this embodiment, there does not occur the above-described inconvenience. FIGS. 19(*a*) and 19(*b*) are views illustrating the return of oil when the turned-over watercraft 10 is recovered (returned to a normal posture), wherein FIG. 19(*a*) is a front view and FIG. 19(*b*) is a side view. It is to be noted that, in order to clarify the flow of oil, the engine 20 and the oil tank 50 are depicted as being separated from each other in FIG. 19(*b*).

As shown in the figures, when the turned-over watercraft 10 is recovered, the oil having been present in the upper portion (lower portion, during the turn-over condition) of the engine 20 flows down to the oil pan 28. The oil having been present in the main breathing chamber 29*a* is returned mainly via the chain chamber 20*i* as shown by an arrow O4 in FIG. 19(*b*).

The oil that has been present in the breather pipe 67*c* is returned to the oil pan 28 via the main breathing chamber 29*a* or flows in the first sub-breather chamber 67 depending on a tilt state of the breather pipe 67*c*. The oil, which has been present in the first sub-breather chamber 67, is returned to the oil pan 28 via the return passage 67*d*, the ACG chamber 110*c*, and the return passage 20*h* as shown by an arrow O5.

The oil which has been present in the oil sump portion 77*d* of the second sub-breather chamber 77 flows down along the inner wall surface 77*g* of the second sub-breather chamber 77, and is returned to the oil pan 28 via the opening portion 79*c*, the return passage 67*d*, the ACG chamber 110*c*, and the return passage 20*h*.

The watercraft 10 is thus returned to the normal posture. The oil tank system configured as described above has the following functions and effects. Since the breather chambers (the first sub-breather chamber 67 and the second sub-breather chamber 77 in this embodiment) of the dry sump type engine in which the oil tank 50 for storing engine oil is provided independently from the engine 20, are defined in the oil tank 50 and the breather chambers (67 and 77) are in communication with the engine 20, it is possible to eliminate the need of provision of a breather chamber in the head cover 29 or the like of the engine 20, and if such a breather chamber is required to be provided, it is possible to significantly reduce the volume of the breather chamber.

In this embodiment, although the main breathing chamber 29*a* is provided in the head cover 29 of the engine 20, the volume of the main breathing chamber 29*a* is significantly small. Accordingly, the entire size, particularly, the entire height of the engine 20 can be made small, so that the four-cycle engine 20 can be mounted even in the small watercraft body 11.

As a result, it is possible to reduce the degree of environmental pollution and noise occurring from the small watercraft 10. Since the oil tank 50 includes divided cases 60 and 70 jointed to each other, and the breather chambers (67 and 77) are formed by joining the divided cases 60 and 70 to each other, the volume, shape, and the like of each of the breather chambers can be freely set. In this embodiment, the volume, shape, and the like of each of the breather chambers (67 and 77) are configured as described above.

Since the breathing gas inlet 67*b* of the breather chamber (67) is provided in the upper portion of the oil tank 50 and the breathing gas outlet 77*b* of the breather chamber (77) is provided at a position lower than that of the breathing gas inlet 67*b* and the return passage 67*d* for returning oil having been separated in the breather chambers (67 and 77) is provided in the oil tank 50 (in the tank main body 60 in this embodiment), it is possible to ensure the height required for gas-liquid separation in the breather chambers (67 and 77), and also to simply return the separated oil. Since the divided cases 60 and 70 are joined to each other via the gasket 79 and the breather chamber section is partially partitioned into the first breather chamber 67 and the second breather chamber 77 by means of the gasket 79 and the breathing gas inlet 67*b* is provided in the first breather chamber 67 and the breathing gas outlet 77*b* is provided in the second breather chamber 77, it is possible to more certainly perform gas-liquid separation.

Since the oil tank 50 forms the cover portion 66*a* of the ACG disposed at the end of the crankshaft 21 of the engine 20, it is possible to reduce the number of parts and to obtain a noise absorption effect due to oil as compared with a single cover liable to induce radiation noise occurring from the engine 20. Accordingly, it is possible to more reduce the degree of noise occurring from the engine 20.

Since the pulser 118 for taking out a signal is provided on the outer periphery of the ACG in such a manner as to be overlapped to the oil tank 50 in a direction along the crank shaft 21, it is not required to elongate the axial length for the pulser 118. As a result, it is possible to make the engine 20 more compact. Since the water-cooled type oil cooler 90 accommodating portions 64 and 74 are formed integrally with the oil tank 50, it is possible to simplify an oil piping structure and a cooling water piping structure.

Since the oil filter 100 is provided in the oil tank 50 and the oil cooler 90 is interposed in the oil passage extending from the oil filter 100 to the main gallery 20*a* of the engine 20, it is possible to supply the most cooled oil to the main gallery 20*a* of the engine 20, and hence to efficiently cool the engine 20. Since the engine 20 is an engine mounted on a small watercraft for driving the jet pump 30 and cooling water from the cooling water takeoff portion 30*a* of the jet pump 30 is first supplied to the water-cooled type oil cooler 90 accommodating portion 74, it is possible to efficiently cool not only oil passing through the oil cooler 90 but also oil stored in the oil tank 50.

Since the engine 20 is mounted on a small watercraft and the breather chamber (67) forms the oil sump portion for accumulating oil during a turn-over condition of the watercraft, it is possible to prevent the outflow of oil during the turn-over condition. Since the engine 20 is mounted on a small watercraft and the return passage 67*d* forms the breathing passage during a turn-over condition of the watercraft, it is possible to certainly prevent the outflow of oil during a turn-over condition.

Since the engine 20 is mounted on a small watercraft and the sump portion 77*d* for oil which counter flows in the return passage 67*d* during a turn-over condition of the watercraft is provided in the upper portion (lower portion, during a turn-over condition) of the second breather chamber 77, it is possible to prevent the outflow of oil during a turn-over condition with more certainty. Since the engine 20 for driving the jet propelling pump 30 is provided in the watercraft body 11 surrounded by the hull 14 and the deck 15 in such a manner as to extend in the length direction of the watercraft body 11 and the oil tank 50 is provided on the extension of the crankshaft 21 of the engine 20, and also the oil pump 80 driven by the crankshaft 21 is provided in the oil tank 50, it is possible to simplify the oil piping structure.

Since the relief valve 130 for controlling a discharge pressure of the oil pump 80 is provided in the oil tank 50, relief oil from the relief valve 130 is discharged to the oil tank 50. Accordingly, it is possible to reduce the volume of the oil pump 130 as compared with a configuration where relief oil 130 is discharged into the engine 20, e.g., in the oil pan 28.

Since the oil tank 50 is composed of the oil main body 60 and the cover 70 and the relief valve 130 is in communication with the discharge passage 55 of the oil pump 80 and is accommodated in the oil tank 50 in such a manner as to be brought into contact with the cover 70, it is possible to simplify the accommodation and fixture of the relief valve 130. Since the tank main body 60 and the cover 70 are joined to each other with their contact planes 62 and 71 extending substantially in the vertical direction being contact with each other and the relief valve 130 is accommodated in the oil tank 50 in such a manner as to extend in the horizontal direction, it is possible to easily assemble the relief valve 130.

Since the oil pump 80 is accommodated in a portion, on the tank main body 60 side, of the oil tank 50 and the suction/discharge passages 51, 53, 60*a* and 60*b* of the oil pump 80 are formed integrally with the tank main body 60, it is possible to more simplify the oil piping structure. Since the tank main body 60 covers drive chambers for accessories such as the ACG, the balancer shaft 114, and the starter motor 120 of the engine 20, it is possible to eliminate the need of provision of covers specialized for covering the drive chambers for the accessories and hence to make the engine 20 compact, and also to reduce the number of parts and to obtain a noise absorption effect due to oil as compared with single covers liable to induce radiation noise occurring from the engine 20.

Accordingly, it is possible to more reduce the degree of noise of the engine 20. Since the oil filter in communication with the oil pump 80 in the oil tank 50 is provided in the upper portion of the oil tank 50 and the passages 60*a*, 60*b*, 60*e* and 60*f* for communicating the oil tank 50 to the oil filter 100 are formed integrally with the oil tank 50, it is possible to more simplify the oil piping structure.

Since the oil filter 100 is aligned with the opening 15*a* of the deck 15, it is possible to easily perform a work for exchanging the oil filter 100. Since the oil storing portion of the oil tank 50 is vertically elongated, it is possible to reduce entrainment of air in oil due to transverse G at the time of running of the watercraft 10, and since the multi-stepped baffle plates 65*a* and 75*a* are provided in the oil storing portion, it is possible to reduce entrainment of air in oil due to vertical G at the time of running of the watercraft 10.

While the preferred embodiment of the present invention has been described, the present invention is not limited to the embodiment, and it is to be understood that changes and variations may be made without departing from the scope of the present invention. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An oil tank system for a dry sump engine, said oil tank system comprising:

an oil tank for storing engine oil provided independently from said engine; and a breather chamber being provided within said oil tank, said breather chamber being in fluid communication with said engine; said oil tank including a pair of divided cases, said divided cases being joined to each other, and said breather chamber being formed between said divided cases.

2. The oil tank system according to claim 1, further comprising:

a breathing gas inlet for supplying a crankcase gas to said breather chamber being provided in an upper portion of said oil tank;

a breathing gas outlet for discharging the breathing gas from said breather chamber being provided at a position lower than that of said breathing gas inlet; and an oil return passage provided in said oil tank for returning an oil having been separated in said breather chamber.

3. The oil tank system according to claim 2, wherein said divided cases are joined to each other via a gasket; said breather chamber is partially partitioned into a first breather chamber and a second breather chamber by said gasket; and said breathing gas inlet is provided in said first breather chamber and said breathing gas outlet is provided in said second breather chamber.

4. The oil tank system according to claim 3, wherein said oil tank forms a cover portion of an AC generator being disposed at an end of a crankshaft of said engine.

5. The oil tank system according to claim 1, wherein said oil tank forms a cover portion of an AC generator being disposed at an end of a crankshaft of said engine.

6. An oil tank system for a dry sump engine, said oil tank system comprising:

an oil tank for storing engine oil provided independently from said engine;

a breather chamber being provided within said oil tank, said breather chamber being in fluid communication with said engine;

a breathing gas inlet for supplying a crankcase gas to said breather chamber being provided in an upper portion of said oil tank;

a breathing gas outlet for discharging the breathing gas from said breather chamber being provided at a position lower than that of said breathing gas inlet; and an oil return passage provided in said oil tank for returning an oil having been separated in said breather chamber.

7. The oil tank system engine according to claim 1, wherein said divided cases are joined to each other via a gasket; said breather chamber is partially partitioned into a first breather chamber and a second breather chamber by said gasket; and said breathing gas inlet is provided in said first breather chamber and said breathing gas outlet is provided in said second breather chamber.

8. An oil tank system for a dry sump engine, said oil tank system comprising:

an oil tank for storing engine oil provided independently from said engine; and a breather chamber being provided within said oil tank, said breather chamber being in fluid communication with said engine, wherein said oil tank forms a cover portion of an AC generator being disposed at an end of a crankshaft of said engine.

9. The oil tank system according to claim 8, further comprising a pulser for extracting a signal, said pulser being provided on an outer periphery of said AC generator and overlapping said oil tank with respect to a direction along a length of said crankshaft.

10. The oil tank system according to claim 4, further comprising a pulser for extracting a signal, said pulser being provided on an outer periphery of said AC generator and overlapping said oil tank with respect to a direction along a length of said crankshaft.

11. The oil tank system according to claim 10, further comprising a water-cooled oil cooler and an oil cooler accommodating portion formed integrally with said oil tank.

12. The oil tank system according to claim 11, further comprising:

an oil filter being provided in said oil tank; wherein said oil cooler is interposed in an oil passage extending from said oil filter to a main gallery of said engine.

13. An oil tank system for a dry sump engine, said oil tank system comprising:

an oil tank for storing engine oil provided independently from said engine;

a breather chamber being provided within said oil tank, said breather chamber being in fluid communication with said engine; and a water-cooled oil cooler accommodating portion being formed integrally with said oil tank.

14. An oil tank system for a dry sump engine of a personal watercraft, said dry sump engine driving a jet pump drive, said oil tank system comprising:

an oil tank for storing engine oil provided independently from said engine;

a breather chamber being provided within said oil tank, said breather chamber being in fluid communication with said engine;

a water-cooled oil cooler; and an oil cooler accommodating portion formed integrally with said oil tank, wherein cooling water from a cooling water takeoff portion in said jet pump is first supplied to said water-cooled type oil cooler accommodating portion.

15. The oil tank system according to claim 14, wherein said breather chamber forms an oil sump during an inverted, turn-over condition of said oil tank system of said watercraft.

16. The oil tank system according to claim 15, wherein said return passage forms a crankcase breathing passage during said turn-over condition.

17. The oil tank system according to claim 15, further comprising a sump portion for a counterflow of oil in said return passage during said turn-over condition, said sump portion being provided in an upper portion of said second breather chamber.

18. The oil tank system for according to claim 14, said oil tank including a pair of divided cases, said divided cases being joined to each other, and said breather chamber being formed between said divided cases.

19. The oil tank system according to claim 18, further comprising:

a breathing gas inlet for supplying a crankcase gas to said breather chamber being provided in an upper portion of said oil tank; and a breathing gas outlet for discharging the breathing gas from said breather chamber being provided at a position lower than that of said breathing gas inlet; and an oil return passage provided in said oil tank for returning an oil having been separated in said breather chamber.

* * * * *